US011122385B2

(12) United States Patent
Robinson et al.

(10) Patent No.: US 11,122,385 B2
(45) Date of Patent: Sep. 14, 2021

(54) DETERMINATION OF ACOUSTIC PARAMETERS FOR A HEADSET USING A MAPPING SERVER

(71) Applicant: Facebook Technologies, LLC, Menlo Park, CA (US)

(72) Inventors: Philip Robinson, Seattle, WA (US); Carl Schissler, Redmond, WA (US); Peter Henry Maresh, Seattle, WA (US); Andrew Lovitt, Redmond, WA (US); Sebastià Vicenç Amengual Gari, Seattle, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/855,338

(22) Filed: Apr. 22, 2020

(65) Prior Publication Data

US 2020/0314583 A1 Oct. 1, 2020

Related U.S. Application Data

(63) Continuation of application No. 16/366,484, filed on Mar. 27, 2019, now Pat. No. 10,674,307.

(51) Int. Cl.

| | |
|---|---|
| ***H04S 7/00*** | (2006.01) |
| ***H04R 5/033*** | (2006.01) |
| ***H04R 5/04*** | (2006.01) |

(52) U.S. Cl.

CPC ..... *H04S 7/304* (2013.01); *H04R 5/033* (2013.01); *H04R 5/04* (2013.01); *H04S 2400/11* (2013.01); *H04S 2400/15* (2013.01)

(58) Field of Classification Search

None

See application file for complete search history.

(56) References Cited

U.S. PATENT DOCUMENTS

| | | | |
|---|---|---|---|
| 9,942,687 | B1 | 4/2018 | Chemistruck et al. |
| 10,206,055 | B1 | 2/2019 | Mindlin et al. |

(Continued)

FOREIGN PATENT DOCUMENTS

| | | | |
|---|---|---|---|
| WO | WO 2016/014254 | A1 | 1/2016 |
| WO | WO 2018/182274 | A1 | 10/2018 |
| WO | WO 2019/079523 | A1 | 4/2019 |

OTHER PUBLICATIONS

PCT International Search Report and Written Opinion, PCT Application No. PCT/US2020/023071, dated Jul. 3, 2020, 15 pages.

(Continued)

*Primary Examiner* — James K Mooney

(74) *Attorney, Agent, or Firm* — Fenwick & West LLP

(57) ABSTRACT

Determination of a set of acoustic parameters for a headset is presented herein. The set of acoustic parameters can be determined based on a virtual model of physical locations stored at a mapping server. The virtual model describes a plurality of spaces and acoustic properties of those spaces, wherein the location in the virtual model corresponds to a physical location of the headset. A location in the virtual model for the headset is determined based on information describing at least a portion of the local area received from the headset. The set of acoustic parameters associated with the physical location of the headset is determined based in part on the determined location in the virtual model and any acoustic parameters associated with the determined location. The headset presents audio content using the set of acoustic parameters received from the mapping server.

20 Claims, 10 Drawing Sheets

(56) References Cited

U.S. PATENT DOCUMENTS

| | | | | |
|---|---|---|---|---|
| 10,602,298 | B2 | 3/2020 | Raghuvanshi et al. | |
| 2011/0069841 | A1 | 3/2011 | Angeloff et al. | |
| 2012/0093320 | A1 | 4/2012 | Flaks et al. | |
| 2012/0206452 | A1 | 8/2012 | Geisner et al. | |
| 2013/0041648 | A1 | 2/2013 | Osman | |
| 2013/0236040 | A1 | 9/2013 | Crawford et al. | |
| 2015/0373477 | A1* | 12/2015 | Norris | H04M 3/53366 381/303 |
| 2017/0223478 | A1 | 8/2017 | Jot et al. | |
| 2017/0316115 | A1 | 11/2017 | Lewis et al. | |
| 2019/0116448 | A1* | 4/2019 | Schmidt | H04S 3/008 |
| 2020/0037091 | A1 | 1/2020 | Jeon et al. | |

OTHER PUBLICATIONS

Brandenburg, K., et al. "Plausible Augmentation of Auditory Scenes Using Dynamic Binaural Synthesis for Personalized Auditory Realities." Audio Engineering Society Conference, 2018, pp. 1-10.

Plinge, A., et al. "Six-Degrees-of-Freedom Binaural Audio Reproduction of First-Order Ambisonics with Distance Information," Audio Engineering Society Conference, 2018, pp. 1-10.

Traer, J. et al., "Statistics of natural reverberation enable perceptual separation of sound and space," Proceedings of the National Academy of Sciences, 2016, vol. 113, No. 48, pp. E7856-E7865.

United States Office Action, U.S. Appl. No. 16/259,990, dated Jun. 23, 2020, 27 pages.

* cited by examiner

360

| Physical Space ID 365 | Space Configuration ID 370 | Set of Acoustic Parameters 375 |
|---|---|---|
| S1 | S1C1 | {AP11} |
| | S1C2 | {AP12} |
| | ⋮ | ⋮ |
| | S1Cp | {AP1p} |
| S2 | S2C1 | {AP21} |
| | S2C2 | {AP22} |
| | ⋮ | ⋮ |
| | S2Cq | {AP2q} |
| ⋮ | ⋮ | ⋮ |
| Sn | SnC1 | {APn1} |
| | SnC2 | {APn2} |
| | ⋮ | ⋮ |
| | SnCr | {APnr} |

FIG. 3C

DETERMINATION OF ACOUSTIC PARAMETERS FOR A HEADSET USING A MAPPING SERVER

CROSS REFERENCE TO RELATED APPLICATIONS

This application is a continuation of co-pending U.S. application Ser. No. 16/366,484, filed Mar. 27, 2019, which is incorporated by reference in its entirety.

BACKGROUND

The present disclosure relates generally to presentation of audio at a headset, and specifically relates to determination of acoustic parameters for a headset using a mapping server.

A sound perceived at the ears of two users can be different, depending on a direction and a location of a sound source with respect to each user as well as on the surroundings of a room in which the sound is perceived. Humans can determine a location of the sound source by comparing the sound perceived at each set of ears. In an artificial reality environment, simulating sound propagation from an object to a listener may use knowledge about the acoustic parameters of the room, for example a reverberation time or the direction of incidence of the strongest early reflections. One technique for determining the acoustic parameters of a room includes placing a loudspeaker in a desired source location, playing a controlled test signal, and de-convolving the test signal from what is recorded at a listener location. However, such a technique generally requires a measurement laboratory or dedicated equipment in-situ.

To seamlessly place a virtual sound source in an environment, sound signals to each ear are determined based on sound propagation paths from the source, through an environment, to a listener (receiver). Various sound propagation paths can be represented based on a set of frequency dependent acoustic parameters used at a headset for presenting audio content to the receiver (user of the headset). A set of frequency dependent acoustic parameters is typically unique for a specific acoustic configuration of a local environment (room) that has a unique acoustic property. However, storing and updating various sets of acoustic parameters at the headset for all possible acoustic configurations of the local environment is impractical. Various sound propagation paths within a room between a source and a receiver represent a room impulse response, which depends on specific locations of the source and receiver. It is however memory intensive to store measured or simulated room impulse responses for a dense network of all possible source and receiver locations in a space, or even a relatively small subset of the most common arrangements. Therefore, determination of a room impulse response in real-time is computationally intensive as the required accuracy increases.

SUMMARY

Embodiments of the present disclosure support a method, computer readable medium, and apparatus for determining a set of acoustic parameters for presenting audio content at a headset. In some embodiments, the set of acoustic parameters are determined based on a virtual model of physical locations stored at a mapping server connected with the headset via a network. The virtual model describes a plurality of spaces and acoustic properties of those spaces, wherein the location in the virtual model corresponds to a physical location of the headset. The mapping server determines a location in the virtual model for the headset, based on information describing at least a portion of the local area received from the headset. The mapping server determines a set of acoustic parameters associated with the physical location of the headset, based in part on the determined location in the virtual model and any acoustic parameters associated with the determined location. The headset presents audio content to a listener using the set of acoustic parameters received from the mapping server.

BRIEF DESCRIPTION OF THE DRAWINGS

FIG. 3C is an example of a virtual model describing physical spaces and acoustic properties of the physical spaces, in accordance with one or more embodiments.

Figure 1:
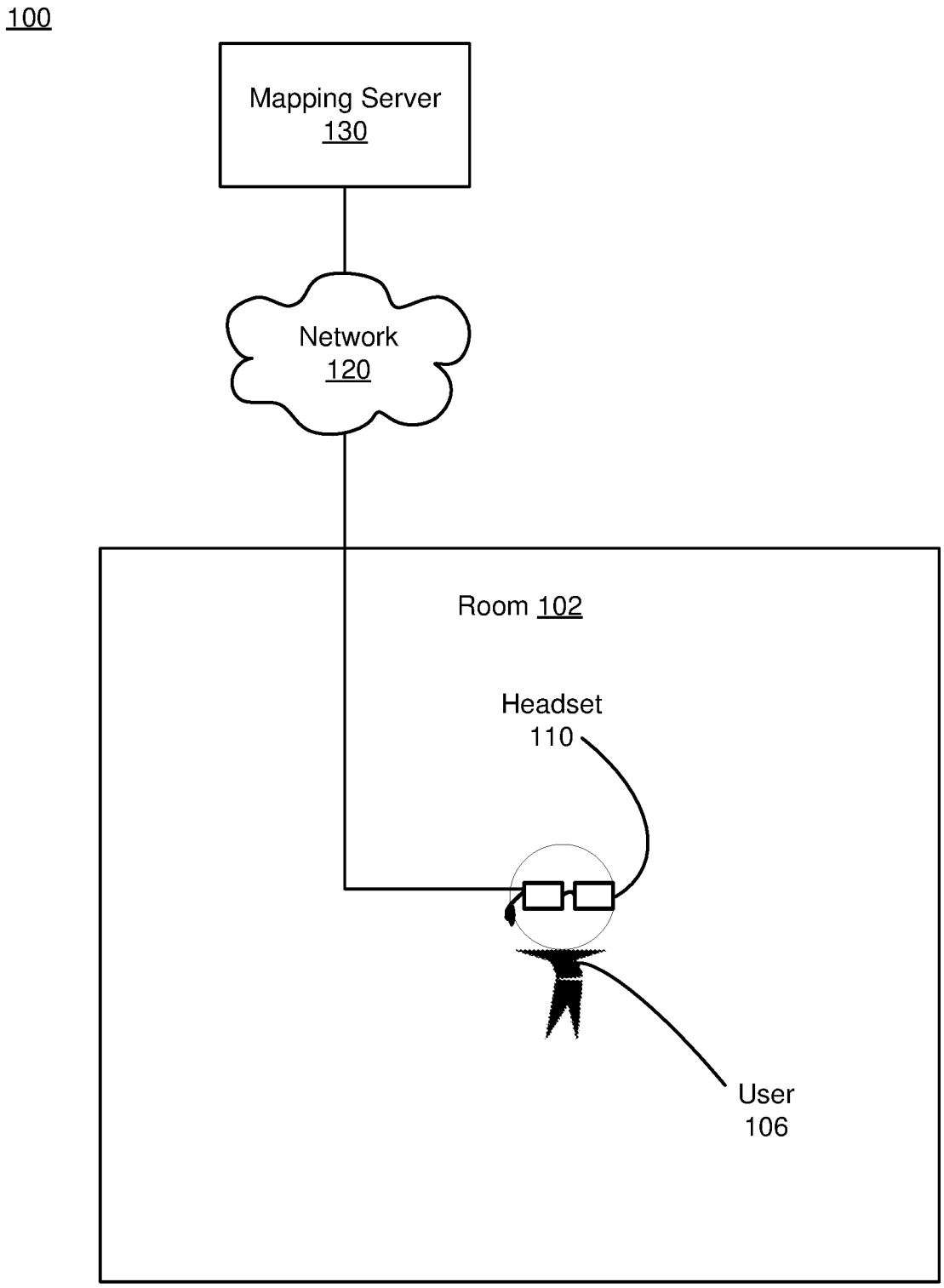
FIG. 1 is a block diagram of a system environment for a headset, in accordance with one or more embodiments.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

Embodiments of the present disclosure may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a headset, a head-mounted display (HMD) connected to a host computer system, a standalone HMD, a near-eye display (NED), a mobile device or computing system, or any other hardware platform capable of providing artificial reality content to one or more viewers.

A communication system for room acoustic matching is presented herein. The communication system includes a headset with an audio system communicatively coupled to a mapping server. The audio system is implemented on a headset, which may include, speakers, an array of acoustic sensors, a plurality of imaging sensors (cameras), and an audio controller. The imaging sensors determine visual information in relation to at least a portion of the local area (e.g., depth information, color information, etc.). The headset communicates (e.g., via a network) the visual information to a mapping server. The mapping server maintains a virtual model of the world that includes acoustic properties for spaces within the real world. The mapping server determines a location in the virtual model that corresponds to the physical location of the headset using the visual information from the headset, e.g., images of at least the portion of the local area. The mapping server determines a set of acoustic parameters (e.g., a reverberation time, a reverberation level, etc.) associated with the determined location and provides the acoustic parameters to the headset. The headset uses (e.g., via the audio controller) the set of acoustic parameters to present audio content to a user of the headset. The array of acoustic sensors mounted on the headset monitors sound in the local area. The headset may selectively provide some or all of the monitored sound as an audio stream to the mapping server, responsive to determining that a change in room configuration has occurred (e.g., a change of human occupancy level, windows are open after being closed, curtains are open after being closed, etc.). The mapping server may update the virtual model by re-computing acoustic parameters based on the audio stream received from the headset.

In some embodiments, the headset obtains information about a set of acoustic parameters that parametrize an impulse response for a local area where the headset is located. The headset may obtain the set of acoustic parameters from the mapping server. Alternatively, the set of acoustic parameters are stored at the headset. The headset may reconstruct an impulse response for a specific spatial arrangement of the headset and a sound source (e.g., a virtual object) by extrapolating the set of acoustic parameters. The reconstructed impulse response may be represented by an adjusted set of acoustic parameters, wherein one or more acoustic parameters from the adjusted set are obtained by dynamically adjusting one or more corresponding acoustic parameters from the original set. The headset presents (e.g., via the audio controller) audio content using the reconstructed impulse response, i.e., the adjusted set of acoustic parameters.

The headset may be, e.g., a NED, HMD, or some other type of headset. The headset may be part of an artificial reality system. The headset further includes a display and an optical assembly. The display of the headset is configured to emit image light. The optical assembly of the headset is configured to direct the image light to an eye box of the headset corresponding to a location of a wearer's eye. In some embodiments, the image light may include depth information for a local area surrounding the headset.

FIG. 1 is a block diagram of a system 100 for a headset 110, in accordance with one or more embodiments. The system 100 includes the headset 110 that can be worn by a user 106 in a room 102. The headset 110 is connected to a mapping server 130 via a network 120.

The network 120 connects the headset 110 to the mapping server 130. The network 120 may include any combination of local area and/or wide area networks using both wireless and/or wired communication systems. For example, the network 120 may include the Internet, as well as mobile telephone networks. In one embodiment, the network 120 uses standard communications technologies and/or protocols. Hence, the network 120 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 120 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 120 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc. The network 120 may also connect multiple headsets located in the same or different rooms to the same mapping server 130.

The headset 110 presents media to a user. In one embodiment, the headset 110 may be a NED. In another embodiment, the headset 110 may be a HMD. In general, the headset 110 may be worn on the face of a user such that content (e.g., media content) is presented using one or both lens of the headset. However, the headset 110 may also be used such that media content is presented to a user in a different manner. Examples of media content presented by the headset 110 include one or more images, video, audio, or some combination thereof.

The headset 110 may determine visual information describing at least a portion of the room 102, and provide the visual information to the mapping server 130. For example, the headset 110 may include at least one depth camera assembly (DCA) that generates depth image data for at least the portion of the room 102. The headset 110 may further include at least one passive camera assembly (PCA) that generates color image data for at least the portion of the room 102. In some embodiments, the DCA and the PCA of the headset 110 are part of simultaneous localization and mapping (SLAM) sensors mounted on the headset 110 for determining visual information of the room 102. Thus, the depth image data captured by the at least one DCA and/or the color image data captured by the at least one PCA can be referred to as visual information determined by the SLAM sensors of the headset 110.

The headset 110 may communicate the visual information via the network 120 to the mapping server 130 for determining a set of acoustic parameters for the room 102. In another embodiment, the headset 110 provides its location information (e.g., Global Positioning System (GPS) location of the room 102) to the mapping server 130 in addition to the visual information for determining the set of acoustic parameters. Alternatively, the headset 110 provides only the location information to the mapping server 130 for determining the set of acoustic parameters. A set of acoustic parameters can be used to represent various acoustic properties of a particular configuration in the room 102 that together define an acoustic condition in the room 102. The configuration in the room 102 is thus associated with a unique acoustic condition in the room 102. A configuration in the room 102 and an associated acoustic condition may change based on at least one of e.g., a change in location of the headset 110 in the room 102, a change in location of a sound source in the room 102, a change of human occupancy level in the room 102, a change of one or more acoustic materials of surfaces in the room 102, by opening/closing windows in the room 102, by opening/closing curtains, by opening/closing a door in the room 102, etc.

The set of acoustic parameters may include some or all of: a reverberation time from the sound source to the headset 110 for each of a plurality of frequency bands, a reverberant level for each frequency band, a direct to reverberant ratio for each frequency band, a direction of a direct sound from the sound source to the headset 110 for each frequency band, an amplitude of the direct sound for each frequency band, a time of early reflection of a sound from the sound source to the headset, an amplitude of early reflection for each frequency band, a direction of early reflection, room mode frequencies, room mode locations, etc. In some embodiments, the frequency dependence of some of the aforementioned acoustic parameters can be clustered into four frequency bands. In some other embodiments, some of the acoustic parameters can be clustered in more or less than four frequency bands. The headset 110 presents audio content to the user 106 using the set of acoustic parameters obtained from the mapping server 130. The audio content is presented to appear originating from an object (i.e., a real object or a virtual object) within the room 102.

The headset 110 may further include an array of acoustic sensors for monitoring sound in the room 102. The headset 110 may generate an audio stream based on the monitored sound. The headset 110 may selectively provide the audio stream to the mapping server 130 (e.g., via the network 120) for updating one or more acoustic parameters for the room 102 at the mapping server 130, responsive to determination that a change in a configuration in the room 102 has occurred causing that an acoustic condition in the room 102 has been changed. The headset 110 presents audio content to the user 106 using an updated set of acoustic parameters obtained from the mapping server 130.

In some embodiments, the headset 110 obtains a set of acoustic parameters parametrizing an impulse response for the room 102, either from the mapping server 130 or from a non-transitory computer readable storage device (i.e., a memory) at the headset 110. The headset 110 may selectively extrapolate the set of acoustic parameters into an adjusted set of acoustic parameters representing a reconstructed room impulse response for a specific configuration of the room 102 that differs from a configuration associated with the obtained set of acoustic parameters. The headset 110 presents audio content to the user of the headset 110 using the reconstructed room impulse response. Furthermore, the headset 110 may include position sensors or an inertial measurement unit (IMU) that tracks the position (e.g., location and pose) of the headset 110 within the room. Additional details regarding operations and components of the headset 110 are discussed below in connection with FIG. 3B, FIG. 4, FIGS. 5B-5C and FIG. 6.

The mapping server 130 facilitates the creation of audio content for the headset 110. The mapping server 130 includes a database that stores a virtual model describing a plurality of spaces and acoustic properties of those spaces, wherein one location in the virtual model corresponds to a current configuration of the room 102. The mapping server 130 receives, from the headset 110 via the network 120, visual information describing at least the portion of the room 102 and/or location information for the room 102. The mapping server 130 determines, based on the received visual information and/or location information, a location in the virtual model that is associated with the current configuration of the room 102. The mapping server 130 determines (e.g., retrieves) a set of acoustic parameters associated with the current configuration of the room 102, based in part on the determined location in the virtual model and any acoustic parameters associated with the determined location. The mapping server 130 may provide information about the set of acoustic parameters to the headset 110 (e.g., via the network 120) for generating audio content at the headset 110. Alternatively, the mapping server 130 may generate an audio signal using the set of acoustic parameters and provide the audio signal to the headset 110 for rendering. In some embodiments, some of the components of the mapping server 130 may be integrated with another device (e.g., a console) connected to the headset 110 via a wired connection (not shown in FIG. 1). Additional details regarding operations and components of the mapping server 130 are discussed below in connection with FIG. 3A, FIG. 3C, FIG. 5A.

Figure 2:
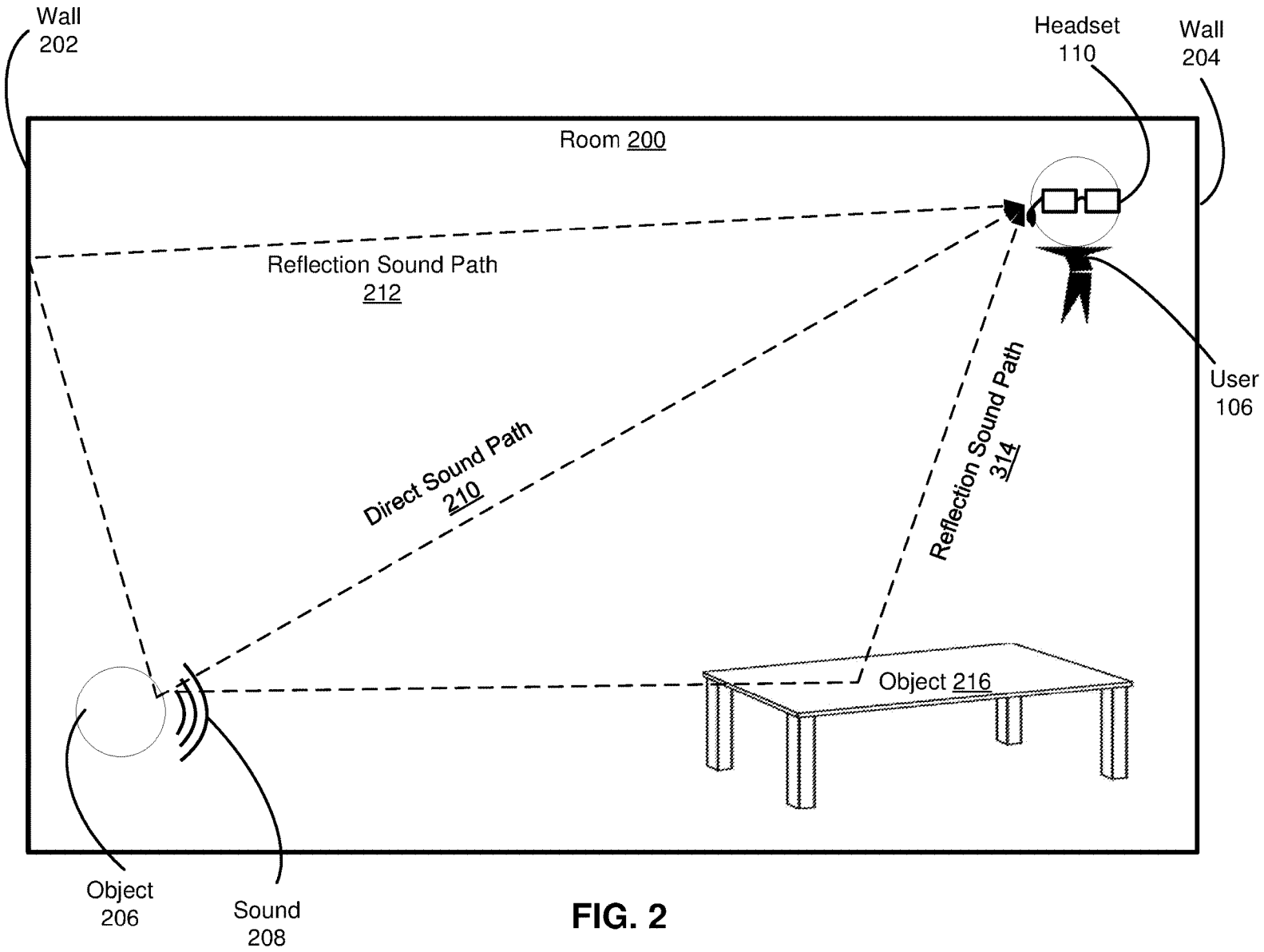
FIG. 2 illustrates effects of surfaces in a room on the propagation of sound between a sound source and a user of a headset, in accordance with one or more embodiments.

FIG. 2 illustrates effects of surfaces in a room 200 on the propagation of sound between a sound source and a user of a headset, in accordance with one or more embodiments. A set of acoustic parameters (e.g., parametrizing a room impulse response) represent how a sound is transformed when traveling in the room 200 from a sound source to a user (receiver), and may include effects of a direct sound path and reflection sound paths traversed by the sound. For example, the user 106 wearing the headset 110 is located in the room 200. The room 200 includes walls, such as walls 202 and 204, which provide surfaces for reflecting sound 208 from an object 206 (e.g., virtual sound source). When the object 206 emits the sound 208, the sound 208 travels to the headset 110 through multiple paths. Some of the sound 208 travels along a direct sound path 210 to the (e.g., right) ear of the user 106 without reflection. The direct sound path 210 may result in an attenuation, filtering, and time delay of the sound caused by the propagation medium (e.g., air) for the distance between the object 206 and the user 106.

Other portions of the sound 208 are reflected before reaching the user 106 and represent reflection sounds. For example, another portion of the sound 208 travels along a reflection sound path 212, where the sound is reflected by the wall 202 to the user 106. The reflection sound path 212 may result in an attenuation, filtering, and time delay of the sound 208 caused by the propagation medium for the distance between the object 206 and the wall 202, another attenuation or filtering caused by a reflection off the wall 202, and another attenuation, filtering, and time delay caused by the propagation medium for the distance between the wall 202 and the user 106. The amount of the attenuation at the wall 202 depends on the acoustic absorption of the wall 202, which can vary based on the material of the wall 202. In another example, another portion of the sound 208 travels along a reflection sound path 214, where the sound 208 is reflected by an object 216 (e.g., a table) and toward the user 106.

Various sound propagation paths 210, 212, 214 within the room 200 represent a room impulse response, which depends on specific locations of a sound source (i.e., the object 206) and a receiver (e.g., the headset 106). The room impulse response contains a wide variety of information about the room, including low frequency modes, diffraction paths, transmission through walls, acoustic material properties of surfaces. The room impulse response can be parametrized using the set of acoustic parameters. Although the reflection sound paths 212 and 214 are examples of first order reflections caused by reflection at a single surface, the set of acoustic parameters (e.g., room impulse response) may incorporate effects from higher order reflections at multiple surfaces or objects. By transforming an audio signal of the object 206 using the set of acoustic parameters, the headset 110 generates audio content for the user 106 that simulates propagation of the audio signal as sound through the room 200 along the direct sound path 210 and reflection sound paths 212, 214.

Note that a propagation path from the object 206 (sound source) to the user 106 (receiver) within the room 200 can be generally divided into three parts: the direct sound path 210, early reflections (e.g., carried by the reflection sound path 214) that correspond to the first order acoustic reflections from nearby surfaces, and late reverberation (e.g., carried by the reflection sound path 212) that corresponds to the first order acoustic reflections from farther surfaces or higher order acoustic reflections. Each sound path has different perceptual requirements affecting rates of updating corresponding acoustic parameters. For example, the user 106 may have very little tolerance for latency in the direct sound path 210, and thus one or more acoustic parameters associated with the direct sound path 210 may be updated at a highest rate. The user 106 may have however more tolerance for latency in early reflections. The late reverberation is the least sensitive to changes in head rotation, because in many cases the late reverberation is isotropic and uniform within a room, hence the late reverberation does not change at the ears with rotational or translational movements. It is also very computationally expensive to compute all perceptually important acoustic parameters related to the late reverberation. For this reason, acoustic parameters associated with early reflections and late reverberation may be efficiently computed off-time, e.g., at the mapping server 130, which does not have as stringent energy and computation limitations as the headset 110, but does have a substantial latency. Details regarding operations of the mapping server 130 for determining acoustic parameters are discussed below in connection with FIG. 3A and FIG. 5A.

Figure 3A:
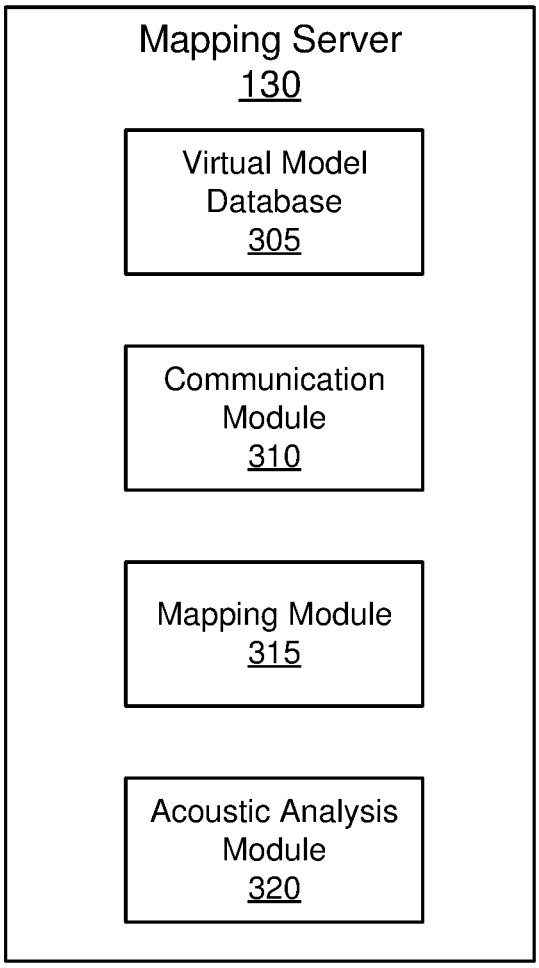
FIG. 3A is a block diagram of a mapping server, in accordance with one or more embodiments.

FIG. 3A is a block diagram of the mapping server 130, in accordance with one or more embodiments. The mapping server 130 determines a set of acoustic parameters for physical space (room) where the headset 110 is located. The determined set of acoustic parameters may be used at the headset 110 to transform an audio signal associated with an object (e.g., virtual or real object) in the room. To add a convincing sound source to the object, the audio signal output from the headset 110 should sound like it has propagated from the object's location to the listener in the same way that a natural source in the same position would. The set of acoustic parameters defines a transformation caused by the propagation of sound from the object within the room to the listener (i.e., to position of the headset within the room), including propagation along a direct path and various reflection paths off surfaces of the room. The mapping server 130 includes a virtual model database 305, a communication module 310, a mapping module 315, and an acoustic analysis module 320. In other embodiments, the mapping server 130 can have any combination of the modules listed with any additional modules. In some other embodiments, the mapping server 130 includes one or more modules that combine functions of the modules illustrated in FIG. 3A. A processor of the mapping server 130 (not shown in FIG. 3A) may run some or all of the virtual model database 305, the communication module 310, the mapping module 315, the acoustic analysis module 320, one or more other modules or modules combining functions of the modules shown in FIG. 3A.

The virtual model database 305 stores a virtual model describing a plurality of physical spaces and acoustic properties of those physical spaces. Each location in the virtual model corresponds to a physical location of the headset 110 within a local area having a specific configuration associated with a unique acoustic condition. The unique acoustic condition represents a condition of the local area having a unique set of acoustic properties represented with a unique set of acoustic parameters. A particular location in the virtual model may correspond to a current physical location of the headset 110 within the room 102. Each location in the virtual model is associated with a set of acoustic parameters for a corresponding physical space that represents one configuration of the local area. The set of acoustic parameters describes various acoustic properties of that one particular configuration of the local area. The physical spaces whose acoustic properties are described in the virtual model include, but are not limited to, a conference room, a bathroom, a hallway, an office, a bedroom, a dining room, and a living room. Hence, the room 102 of FIG. 1 may be a conference room, a bathroom, a hallway, an office, a bedroom, a dining room, or a living room. In some embodiments, the physical spaces can be certain outside spaces (e.g., patio, garden, etc.) or combination of various inside and outside spaces. More details about a structure of the virtual model are discussed below in connection with FIG. 3C.

The communication module 310 is a module that communicates with the headset 130 via the network 120. The communication module 310 receives, from the headset 130, visual information describing at least the portion of the room 102. In one or more embodiments, the visual information includes image data for at least the portion of the room 102. For example, the communication module 310 receives depth image data captured by the DCA of the headset 110 with information about a shape of the room 102 defined by surfaces of the room 102, such as surfaces of the walls, floor and ceiling of the room 102. The communication module 310 may also receive color image data captured by the PCA of the headset 110. The mapping server 130 may use the color image data to associate different acoustic materials with the surfaces of the room 102. The communication module 310 may provide the visual information received from the headset 130 (e.g., the depth image data and the color image data) to the mapping module 315.

The mapping module 315 maps the visual information received from the headset 110 to a location of the virtual model. The mapping module 315 determines the location of the virtual model corresponding to a current physical space where the headset 110 is located, i.e., a current configuration of the room 102. The mapping module 315 searches through the virtual model to find mapping between (i) the visual information that include at least e.g., information about geometry of surfaces of the physical space and information about acoustic materials of the surfaces and (ii) a corresponding configuration of the physical space within the virtual model. The mapping is performed by matching the geometry and/or acoustic materials information of the received visual information with geometry and/or acoustic materials information that is stored as part of the configuration of the physical space within the virtual model. The corresponding configuration of the physical space within the virtual model corresponds to a model of the physical space where the headset 110 is currently located. If no matching is found, this is an indication that a current configuration of the physical space is not yet modeled within the virtual model. In such case, the mapping module 315 may inform the acoustic analysis module 320 that no matching is found, and the acoustic analysis module 320 determines a set of acoustic parameters based at least in part on the received visual information.

The acoustic analysis module 320 determines the set of acoustic parameters associated with the physical location of the headset 110, based in part on the determined location in the virtual model obtained from the mapping module 315 and any acoustic parameters in the virtual model associated with the determined location. In some embodiments, the acoustic analysis module 320 retrieves the set of acoustic parameters from the virtual model, as the set of acoustic parameters are stored at the determined location in the virtual model that is associated with a specific space configuration. In some other embodiments, the acoustic analysis module 320 determines the set of acoustic parameters by adjusting a previously determined set of acoustic parameters for a specific space configuration in the virtual model, based at least in part on the visual information received from the headset 110. For example, the acoustic analysis module 320 may run off-line acoustic simulation using the received visual information to determine the set of acoustic parameters.

In some embodiments, the acoustic analysis module 320 determines that previously generated acoustic parameters are not consistent with an acoustic condition of the current physical location of the headset 110, e.g., by analyzing an ambient sound that is captured and obtained from the headset 110. The detected miss-match may trigger regeneration of a new set of acoustic parameters at the mapping server 130. Once re-computed, this new set of acoustic parameters may be entered into the virtual model of the mapping server 130 as a replacement for the previous set of acoustic parameters, or as an additional state for the same physical space. In some embodiments, the acoustic analysis module 320 estimates a set of acoustic parameters by analyzing the ambient sound (e.g., speech) received from the headset 110. In some other embodiments, the acoustic analysis module 320 derives a set of acoustic parameters by running an acoustic simulation (e.g., a wave-based acoustic simulation or ray tracing acoustic simulation) using the visual information received from the headset 110 that may include the room geometry and estimates of the acoustic material properties. The acoustic analysis module 320 provides the derived set of acoustic parameters to the communication module 310 that communicates the set of acoustic parameters from the mapping server 130 to the headset 110, e.g., via the network 120.

In some embodiments, as discussed, the communication module 310 receives an audio stream from the headset 110, which may be generated at the headset 110 using sound in the room 102. The acoustic analysis module 320 may determine (e.g., by applying a server-based computational algorithm) one or more acoustic parameters for a specific configuration of the room 102, based on the received audio stream. In some embodiments, the acoustic analysis module 320 estimates the one or more acoustic parameters (e.g., a reverberation time) from the audio stream, based on e.g., a statistical model for a sound decay in the audio stream that employs a maximum-likelihood estimator. In some other embodiments, the acoustic analysis module 320 estimates the one or more acoustic parameters based on e.g., time domain information and/or frequency domain information extracted from the received audio stream.

In some embodiments, the one or more acoustic parameters determined by the acoustic analysis module 320 represent a new set of acoustic parameters that was not part of the virtual model as a current configuration of the room 102 and a corresponding acoustic condition of the room 102 were not modeled by the virtual model. In such case, the virtual model database 305 stores the new set of acoustic parameters at a location within the virtual model that is associated with a current configuration of the room 102 modelling a current acoustic condition of the room 102. Some or all of the one or more acoustic parameters (e.g., a frequency dependent reverberation time, a frequency dependent direct to reverberant ratio, etc.) may be stored in the virtual model along with a confidence (weight) and an absolute time stamp associated with that acoustic parameter, which can be used for re-computing some of the acoustic parameters.

In some embodiments, a current configuration of the room 102 has been already modeled by the virtual model, and the acoustic analysis module 320 re-computes the set of acoustic parameters based on the received audio stream. Alternatively, one or more acoustic parameters in the re-computed set may be determined at the headset 110 based on, e.g., at least sound in the local area monitored at the headset 110, and communicated to the mapping server 130. The virtual model database 305 may update the virtual model by replacing the set of acoustic parameters with the re-computed set of acoustic parameters. In one or more embodiments, the acoustic analysis module 320 compares the re-computed set of acoustic parameters with the previously determined set of acoustic parameters. Based on the comparison, when a difference between any of the re-computed acoustic parameters and any of the previously determined acoustic parameter is above a threshold difference, the virtual model is updated using the re-computed set of acoustic parameters.

In some embodiments, the acoustic analysis module 320 combines any of the re-computed acoustic parameters with past estimates of a corresponding acoustic parameter for the same configuration of a local area, if the past estimates are within a threshold value from a re-computed acoustic parameter. The past estimates may be stored in the virtual model database 305 at a location of the virtual model associated with the corresponding configuration of the local area. In one or more embodiments, the acoustic analysis module 320 applies weights on the past estimates (e.g., weights based on time stamps associated with the past estimates or stored weights), if the past estimates are not within the threshold value from the re-computed acoustic parameter. In some embodiments, the acoustic analysis module 320 applies a material optimization algorithm on estimates for at least one acoustic parameter (e.g., a reverberation time) and geometry information for a physical space where the headset 110 is located to determine different acoustic materials that would produce the estimates for the at least one acoustic parameter. Information about the acoustic materials along with the geometry information may be stored in different locations of the virtual model that model different configurations and acoustic conditions of the same physical space.

In some embodiments, the acoustic analysis module 320 may perform acoustic simulations to generate spatially dependent pre-computed acoustic parameters (e.g., a spatially dependent reverberation time, a spatially dependent direct to reverberant ratio, etc.). The spatially dependent pre-computed acoustic parameters may be stored in appropriate locations of the virtual model at the virtual model database 305. The acoustic analysis module 320 may recompute spatially dependent acoustic parameters using the pre-computed acoustic parameters whenever geometry and/or acoustic materials of a physical space change. The acoustic analysis module 320 may use various inputs for the acoustic simulations, such as but not limited to: information about a room geometry, acoustic material property estimates, and/or information about a human occupancy level (e.g., empty, partially full, full). The acoustic parameters may be simulated for various occupancy levels, and various states of a room (e.g. open windows, closed windows, curtains open, curtains closed, etc.). If a state of the room changes, the mapping server 130 may determine and communicate to the headset 110 an appropriate set of acoustic parameters for presenting audio content to user. Otherwise, if the appropriate set of acoustic parameters is not available, the mapping server 130 (e.g., via the acoustic analysis module 320) would calculate a new set of acoustic parameters (e.g., via the acoustic simulations) and communicate the new set of acoustic parameters to the headset 110.

In some embodiments, the mapping server 130 stores a full (measured or simulated) room impulse response for a given configuration of the local area. For example, the configuration of the local area may be based on a specific spatial arrangement of the headset 110 and a sound source. The mapping server 130 may reduce the room impulse response into a set of acoustic parameters suitable for a defined bandwidth of network transmission (e.g., a bandwidth of the network 120). The set of acoustic parameters representing a parametrized version of a full impulse response may be stored, e.g., in the virtual model database 305 as part of the virtual mode, or in a separate non-transitory computer readable storage medium of the mapping server 130 (not shown in FIG. 3A).

Figure 3B:
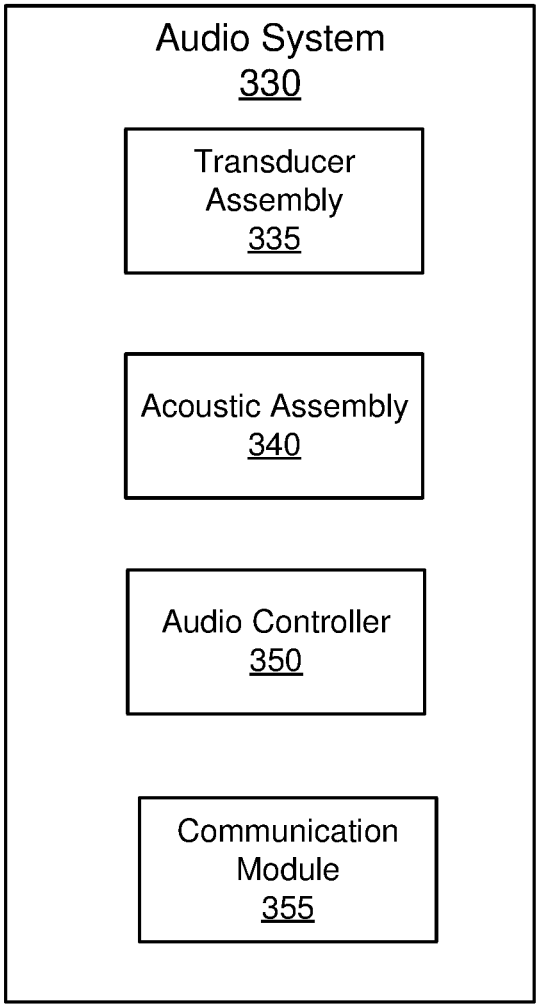
FIG. 3B is a block diagram of an audio system of a headset, in accordance with one or more embodiments.

FIG. 3B is a block diagram of an audio system 330 of the headset 110, in accordance with one or more embodiments. The audio system 330 includes a transducer assembly 335, an acoustic assembly 340, an audio controller 350, and a communication module 355. In one embodiment, the audio system 330 further comprises an input interface (not shown in FIG. 3B) for, e.g., controlling operations of different components of the audio system 330. In other embodiments, the audio system 330 can have any combination of the components listed with any additional components.

The transducer assembly 335 produces sound for user's ears, e.g., based on audio instructions from the audio controller 350. In some embodiments, the transducer assembly 335 is implemented as pair of air conduction transducers (e.g., one for each ear) that produce sound by generating an airborne acoustic pressure wave in the user's ears, e.g., in accordance with the audio instructions from the audio controller 350. Each air conduction transducer of the transducer assembly 335 may include one or more transducers to cover different parts of a frequency range. For example, a piezoelectric transducer may be used to cover a first part of a frequency range and a moving coil transducer may be used to cover a second part of a frequency range. In some other embodiments, each transducer of the transducer assembly 335 is implemented as a bone conduction transducer that produces sound by vibrating a corresponding bone in the user's head. Each transducer implemented as a bone conduction transducer may be placed behind an auricle coupled to a portion of the user's bone to vibrate the portion of the user's bone that generates a tissue-borne acoustic pressure wave propagating toward the user's cochlea, thereby bypassing the eardrum.

The acoustic assembly 340 may include a plurality of acoustic sensors, e.g., one acoustic sensor for each ear. Alternatively, the acoustic assembly 340 includes an array of acoustic sensors (e.g., microphones) mounted on various locations of the headset 110. An acoustic sensor of the acoustic assembly 340 detects acoustic pressure waves at the entrance of the ear. One or more acoustic sensors of the acoustic assembly 340 may be positioned at an entrance of each ear. The one or more acoustic sensors are configured to detect the airborne acoustic pressure waves formed at an entrance of the ear. In one embodiment, the acoustic assembly 340 provides information regarding the produced sound to the audio controller 350. In another embodiment, the acoustic assembly 340 transmits feedback information of the detected acoustic pressure waves to the audio controller 350, and the feedback information may be used by the audio controller 350 for calibration of the transducer assembly 335.

In one embodiment, the acoustic assembly 340 includes a microphone positioned at an entrance of each ear of a wearer. A microphone is a transducer that converts pressure into an electrical signal. The frequency response of the microphone may be relatively flat in some portions of a frequency range and may be linear in other portions of a frequency range. The microphone may be configured to receive a signal from the audio controller 350 to scale a detected signal from the microphone based on the audio instructions provided to the transducer assembly 335. For example, the signal may be adjusted based on the audio instructions to avoid clipping of the detected signal or for improving a signal to noise ratio in the detected signal.

In another embodiment, the acoustic assembly 340 includes a vibration sensor. The vibration sensor is coupled to a portion of the ear. In some embodiments, the vibration sensor and the transducer assembly 335 couple to different portions of the ear. The vibration sensor is similar to an air transducer used in the transducer assembly 335 except the signal is flowing in reverse. Instead of an electrical signal producing a mechanical vibration in a transducer, a mechanical vibration is generating an electrical signal in the vibration sensor. A vibration sensor may be made of piezoelectric material that can generate an electrical signal when the piezoelectric material is deformed. The piezoelectric material may be a polymer (e.g., PVC, PVDF), a polymer-based composite, ceramic, or crystal (e.g., $SiO_2$, PZT). By applying a pressure on the piezoelectric material, the piezoelectric material changes in polarization and produces an electrical signal. The piezoelectric sensor may be coupled to a material (e.g., silicone) that attaches well to the back of ear. A vibration sensor can also be an accelerometer. The accelerometer may be piezoelectric or capacitive. In one embodiment, the vibration sensor maintains good surface contact with the back of the wearer's ear and maintains a steady amount of application force (e.g., 1 Newton) to the ear. The vibration sensor may be integrated in an IMU integrated circuit. The IMU is further described with relation to FIG. 6.

The audio controller 350 provides audio instructions to the transducer assembly 335 for generating sound by generating audio content using a set of acoustic parameters (e.g., a room impulse response). The audio controller 350 presents the audio content to appear originating from an object (e.g., virtual object or real object) within a local area of the headset 110. In an embodiment, the audio controller 350 presents the audio content to appear originating from a virtual sound source by transforming a source audio signal using the set of acoustic parameters for a current configuration of the local area, which may parametrize the room impulse response for the current configuration of the local area.

The audio controller 350 may obtain information describing at least a portion of the local area, e.g., from one or more cameras of the headset 110. The information may include depth image data, color image data, location information of the local area, or combination thereof. The depth image data may include geometry information about a shape of the local area defined by surfaces of the local area, such as surfaces of the walls, floor and ceiling of the local area. The color image data may include information about acoustic materials associated with surfaces of the local area. The location information may include GPS coordinates or some other positional information of the local area.

In some embodiments, the audio controller 350 generates an audio stream based on sound in the local area monitored by the acoustic assembly 340 and provides the audio stream to the communication module 355 to be selectively communicated to the mapping server 130. In some embodiments, the audio controller 350 runs a real-time acoustic ray tracing simulation to determine one or more acoustic parameters (e.g., early reflections, a direct sound occlusion, etc.). To be able to run the real-time acoustic ray tracing simulation, the audio controller 350 requests and obtains, e.g., from the virtual model stored at the mapping server 130, information about geometry and/or acoustic parameters for a configuration of the local area where the headset 110 is currently located. In some embodiments, the audio controller 350 determines one or more acoustic parameters for a current configuration of the local area using sound in the local area monitored by the acoustic assembly 340 and/or vision information determined at the headset 110, e.g., by one or more of the SLAM sensors mounted on the headset 110.

The communication module 355 (e.g., a transceiver) is coupled to the audio controller 350 and may be integrated as a part of the audio controller 350. The communication module 355 may communicate the information describing at least the portion of the local area to the mapping server 130 for determination of a set of acoustic parameters at the mapping server 130. The communication module 355 may selectively communicate the audio stream obtained from the audio controller 350 to the mapping server 130 for updating the visual model of physical spaces at the mapping server 130. For example, the communication module 355 communicates the audio stream to the mapping server 130 responsive to determination (e.g., by the audio controller 350 based on the monitored sound) that a change of an acoustic condition of the local area over time is above a threshold change due to a change of a configuration of the local area, which requires a new or updated set of acoustic parameters. In some embodiments, the audio controller 350 determines that the change of the acoustic condition of the local area is above the threshold change by periodically analyzing the ambient audio stream and e.g., by periodically estimating a reverberation time from the audio stream that is changing over time. For example, the change of acoustic condition can be caused by changing human occupancy level (e.g., empty, partially full, full) in the room 102, by opening or closing windows in the room 102, opening or closing door of the room 102, opening or closing curtains on the windows, changing a location of the headset 110 in the room 102, changing a location of a sound source in the room 102, changing some other feature in the room 102, or combination thereof. In some embodiments, the communication module 355 communicates the one or more acoustic parameters determined by the audio controller 350 to the mapping server 130 for comparing with a previously determined set of acoustic parameters associated with the current configuration of the local area to possibly update the virtual model at the mapping server 130.

In one embodiment, the communication module 355 receives a set of acoustic parameters for a current configuration of the local area from the mapping server 130. In another embodiment, the audio controller 350 determines the set of acoustic parameters for the current configuration of the local area based on, e.g., visual information of the local area determined by one or more of the SLAM sensors mounted on the headset 110, sound in the local area monitored by the acoustic assembly 340, information about a position of the headset 110 in the local area determined by the position sensor 440, information about position of a sound source in the local area, etc. In yet another embodiment, the audio controller 350 obtains the set of acoustic parameters from a computer-readable data storage (i.e., memory) coupled to the audio controller 350 (not shown in FIG. 3B). The memory may store different sets of acoustic parameters (room impulse responses) for a limited number of configurations of physical spaces. The set of acoustic parameters may represent a parametrized form of a room impulse response for the current configuration of the local area.

The audio controller 350 may selectively extrapolate the set of acoustic parameters into an adjusted set of acoustic parameters (i.e., a reconstructed room impulse response), responsive to a change over time in a configuration of the local area that causes a change in an acoustic condition of the local area. The change of acoustic condition of the local area over time can be determined by the audio controller 350 based on, e.g., visual information of the local area, monitored sound in the local area, information about a change in position of the headset 110 in the local area, information about a change in position of the sound source in the local area, etc. As some acoustic parameters in the set are changing in a systematic manner as a configuration of the local area changes (e.g., due to moving of the headset 110 and/or the sound source in the local area), the audio controller 350 may apply an extrapolation scheme to dynamically adjust some of the acoustic parameters.

In one embodiment, the audio controller 350 dynamically adjusts, using an extrapolation scheme, e.g., an amplitude and direction of a direct sound, a delay between a direct sound and early reflections, and/or a direction and amplitude of early reflections, based on information about room geometry and pre-calculated image sources (e.g., in one iteration). In another embodiment, the audio controller 350 dynamically adjusts some of the acoustic parameters based on e.g., a data driven approach. In such case, the audio controller 350 may train a model with measurements of a defined number of rooms and source/receiver locations, and the audio controller 350 may predict an impulse response for a specific novel room and source/receiver arrangement based on the a priori knowledge. In yet another embodiment, the audio controller 350 dynamically adjusts some of the acoustic parameters by interpolating acoustic parameters associated with two rooms as a listener nears the connection between the rooms. A parametrized representation of a room impulse response represented with a set of acoustic parameters can be therefore adapted dynamically. The audio controller 350 may generate audio instructions for the transducer assembly 335 based at least in part on the dynamically adapted room impulse response.

The audio controller 350 may reconstruct a room impulse response for a specific configuration of the local area by applying an extrapolation scheme on the set of acoustic parameters received from the mapping server 130. Acoustic parameters that represent a parametrized form of a room impulse response and are related to perceptually relevant room impulse response features may include some or all of: a reverberation time from the sound source to the headset 110 for each of a plurality of frequency bands, a reverberant level for each frequency band, a direct to reverberant ratio for each frequency band, a direction of a direct sound from the sound source to the headset 110 for each frequency band, an amplitude of the direct sound for each frequency band, a time of early reflection of a sound from the sound source to the headset, an amplitude of early reflection for each frequency band, a direction of early reflection, room mode frequencies, room mode locations, one or more other acoustic parameters, or combination thereof.

The audio controller 350 may perform a spatial extrapolation on the received set of acoustic parameters to obtain an adjusted set of acoustic parameters that represents a reconstructed room impulse response for a current configuration of the local area. When performing the spatial extrapolation, the audio controller 350 may adjust multiple acoustic parameters, such as: a direction of direct sound, an amplitude of direct sound relative to reverberation, a direct sound equalization according to source directivity, a timing of early reflection, an amplitude of early reflection, a direction of early reflection, etc. Note that the reverberation time may remain constant within a room, and may need to be adjusted at intersection of rooms.

In one embodiment, to adjust early reflection timing/amplitude/direction, the audio controller 350 performs extrapolation based on a direction of arrival (DOA) per sample or reflection. In such case, the audio controller 350 may apply an offset to the entire DOA vector. Note that the DOA of early reflections may be determined by processing audio data obtained by the array of microphones mounted on the headset 110. The DOA of early reflections may be then adjusted based on, e.g., a user's position in the room 102 and information about the room geometry.

In another embodiment, when room geometry and source/listener position are known, the audio controller 350 may identify low order reflections based on an image source model (ISM). As the listener moves, the timing and direction of the identified reflections are modified by running the ISM. In such case, an amplitude can be adjusted, whereas a coloration may not be manipulated. Note that an ISM represents a simulation model that determines a source position of early reflections, independent of a listener's position. The early reflection directions can then be calculated by tracing from an image source to the listener. Storing and utilizing image sources for a given source yields early reflection directions for any listener position in the room 102.

In yet another embodiment, the audio controller 350 may apply the "shoebox model" of the room 102 to extrapolate acoustic parameters related to early reflection timing/amplitude/direction. The "shoebox model" is an approximation of room acoustics based on a rectangular box of approximately same size as the actual space. The "shoebox model" can be used to approximate reflections or reverberation time based on, e.g., the Sabine equation. The strongest reflections of an original room impulse response (e.g., measured or simulated for a given source/receiver arrangement) are labeled and removed. Then, the strongest reflections are reintroduced using a low order ISM of the "shoebox model" to obtain an extrapolated room impulse response.

FIG. 3C is an example of a virtual model 360 describing physical spaces and acoustic properties of the physical spaces, in accordance with one or more embodiments. The virtual model 360 may be stored in the virtual model database 305. The virtual model 360 may represent geographic information storage area in the virtual storage database 305 that stores geographically tied triplets of information (i.e., a physical space identifier (ID) 365, a space configuration ID 370, and a set of acoustic parameters 375) for all spaces in the world.

The virtual model 360 includes a listing of possible physical spaces S1, S2, . . . , Sn, each identified by a unique physical space ID 365. A physical space ID 365 uniquely identifies a particular type of physical space. The physical space ID 365 may include, e.g., a conference room, a bathroom, a hallway, an office, a bedroom, a dining room, and a living room, some other type of physical space, or some combination thereof. Thus, each physical space ID 365 corresponds to one particular type of physical space.

Each physical space ID 365 is associated with one or more space configuration IDs 370. Each space configuration ID 370 corresponds to a configuration of a physical space identified by the physical space ID 335 that has a specific acoustic condition. The space configuration ID 370 may include, e.g., an identification about a human occupancy level in the physical space, an identification about conditions of components of the physical space (e.g., open/closed windows, open/closed door, etc.), an indication about acoustic materials of objects and/or surfaces in the physical space, an indication about locations of a source and a receiver in the same space, some other type of configuration indication, or some combination thereof. In some embodiments, different configurations of the same physical space can be due to various different conditions in the physical space. Different configurations of the same physical space may be related to, e.g., different occupancies of the same physical space, different conditions of components of the same physical space (e.g., open/closed windows, open/closed door, etc.), different acoustic materials of objects and/or surfaces in the same physical space, different locations of source/receiver in the same physical space, some other feature of the physical space, or some combination thereof. Each space configuration ID 370 may be represented as a unique code ID (e.g., a binary code) that identifies a configuration of a physical space ID 365. For example, as illustrated in FIG. 3C, the physical space S1 can be associated with p different space configurations S1C1, S1C2, . . . , S1Cp each representing a different acoustic condition of the same physical space S1; the physical space S2 can be associated with q different space configurations S2C1, S2C2, . . . , S2Cq each representing a different acoustic condition of the same physical space S2; the physical space Sn can be associated with r different space configurations SnC1, SnC2, . . . , SnCr each representing a different acoustic condition of the same physical space Sn. The mapping module 315 may search through the virtual model 360 to find an appropriate space configuration ID 370 based on visual information of a physical space received from the headset 110.

Each space configuration ID 370 has a specific acoustic condition that is associated with a set of acoustic parameters 375 stored in a corresponding location of the virtual model 360. As illustrated in FIG. 3C, p different space configurations S1C1, S1C2, . . . , S1Cp of the same physical space S1 are associated with p different sets of acoustic parameters {AP11}, {AP12}, . . . , {AP1*p*}. Similarly, as further illustrated in FIG. 3C, q different space configurations S2C1, S2C2, . . . , S2Cq of the same physical space S2 are associated with q different sets of acoustic parameters {AP21}, {AP22}, . . . , {AP2*q*}; and r different space configurations SnC1, SnC2, . . . , SnCr of the same physical space Sn are associated with r different sets of acoustic parameters {APn1}, {APn2}, . . . , {APnr}. The acoustic analysis module 320 may pull out a corresponding set of acoustic parameters 375 from the virtual model 360 once the mapping module 315 finds a space configuration ID 370 that corresponds to a current configuration of a physical space where the headset 110 is located.

Figure 4:
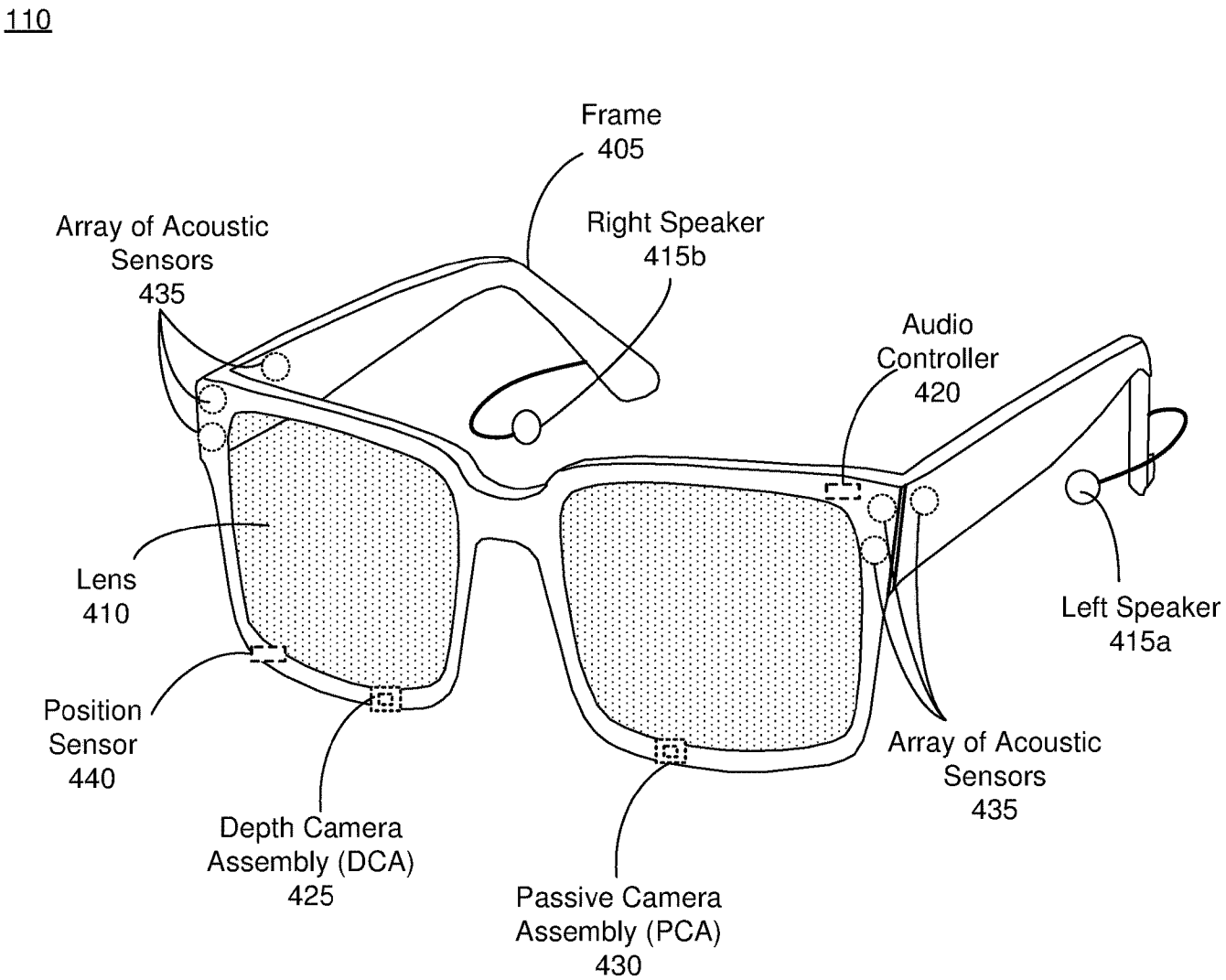
FIG. 4 is a perspective view of a headset including an audio system, in accordance with one or more embodiments.

FIG. 4 is a perspective view of the headset 110 including an audio system, in accordance with one or more embodiments. In some embodiments (as shown in FIG. 1), the headset 110 is implemented as a NED. In alternate embodiments (not shown in FIG. 1), the headset 100 is implemented as an HMD. In general, the headset 110 may be worn on the face of a user such that content (e.g., media content) is presented using one or both lenses 410 of the headset 110. However, the headset 110 may also be used such that media content is presented to a user in a different manner. Examples of media content presented by the headset 110 include one or more images, video, audio, or some combination thereof. The headset 110 may include, among other components, a frame 405, a lens 410, a DCA 425, a PCA 430, a position sensor 440, and an audio system. The audio system of the headset 110 includes, e.g., a left speaker 415*a*, a right speaker 415*b*, an array of acoustic sensors 435, an audio controller 420, one or more other components, or combination thereof. The audio system of the headset 110 is an embodiment of the audio system 330 described above in conjunction with FIG. 3B. The DCA 425 and the PCA 430 may be part of SLAM sensors mounted the headset 110 for capturing visual information of a local area surrounding some or all of the headset 110. While FIG. 4 illustrates the components of the headset 110 in example locations on the headset 110, the components may be located elsewhere on the headset 110, on a peripheral device paired with the headset 110, or some combination thereof.

The headset 110 may correct or enhance the vision of a user, protect the eye of a user, or provide images to a user. The headset 110 may be eyeglasses which correct for defects in a user's eyesight. The headset 110 may be sunglasses which protect a user's eye from the sun. The headset 110 may be safety glasses which protect a user's eye from impact. The headset 110 may be a night vision device or infrared goggles to enhance a user's vision at night. The headset 110 may be a near-eye display that produces artificial reality content for the user. Alternatively, the headset 110 may not include a lens 410 and may be a frame 405 with an audio system that provides audio content (e.g., music, radio, podcasts) to a user.

The frame 405 holds the other components of the headset 110. The frame 405 includes a front part that holds the lens 410 and end pieces to attach to a head of the user. The front part of the frame 405 bridges the top of a nose of the user. The end pieces (e.g., temples) are portions of the frame 405 to which the temples of a user are attached. The length of the end piece may be adjustable (e.g., adjustable temple length) to fit different users. The end piece may also include a portion that curls behind the ear of the user (e.g., temple tip, ear piece).

The lens 410 provides or transmits light to a user wearing the headset 110. The lens 410 may be prescription lens (e.g., single vision, bifocal and trifocal, or progressive) to help correct for defects in a user's eyesight. The prescription lens transmits ambient light to the user wearing the headset 110. The transmitted ambient light may be altered by the prescription lens to correct for defects in the user's eyesight. The lens 410 may be a polarized lens or a tinted lens to protect the user's eyes from the sun. The lens 410 may be one or more waveguides as part of a waveguide display in which image light is coupled through an end or edge of the waveguide to the eye of the user. The lens 410 may include an electronic display for providing image light and may also include an optics block for magnifying image light from the electronic display.

The speakers 415*a* and 415*b* produce sound for user's ears. The speakers 415*a*, 415*b* are embodiments of transducers of the transducer assembly 335 in FIG. 3B. The speakers 415*a* and 415*b* receive audio instructions from the audio controller 420 to generate sounds. The left speaker 415*a* may obtains a left audio channel from the audio controller 420, and the right speaker 415*b* obtains and a right audio channel from the audio controller 420. As illustrated in FIG. 4, each speaker 415*a*, 415*b* is coupled to an end piece of the frame 405 and is placed in front of an entrance to the corresponding ear of the user. Although the speakers 415*a* and 415*b* are shown exterior to the frame 405, the speakers 415*a* and 415*b* may be enclosed in the frame 405. In some embodiments, instead of individual speakers 415*a* and 415*b* for each ear, the headset 110 includes a speaker array (not shown in FIG. 4) integrated into, e.g., end pieces of the frame 405 to improve directionality of presented audio content.

The DCA 425 captures depth image data describing depth information for a local area surrounding the headset 110, such as a room. In some embodiments, the DCA 425 may include a light projector (e.g., structured light and/or flash illumination for time-of-flight), an imaging device, and a controller (not shown in FIG. 4). The captured data may be images captured by the imaging device of light projected onto the local area by the light projector. In one embodiment, the DCA 425 may include a controller and two or more cameras that are oriented to capture portions of the local area in stereo. The captured data may be images captured by the two or more cameras of the local area in stereo. The controller of the DCA 425 computes the depth information of the local area using the captured data and depth determination techniques (e.g., structured light, time-of-flight, stereo imaging, etc.). Based on the depth information, the controller of the DCA 425 determines absolute positional information of the headset 110 within the local area. The controller of the DCA 425 may also generate a model of the local area. The DCA 425 may be integrated with the headset 110 or may be positioned within the local area external to the headset 110. In some embodiments, the controller of the DCA 425 may transmit the depth image data to the audio controller 420 of the headset 110, e.g. for further processing and communication to the mapping server 130.

The PCA 430 includes one or more passive cameras that generate color (e.g., RGB) image data. Unlike the DCA 425 that uses active light emission and reflection, the PCA 430 captures light from the environment of a local area to generate color image data. Rather than pixel values defining depth or distance from the imaging device, pixel values of the color image data may define visible colors of objects captured in the image data. In some embodiments, the PCA 430 includes a controller that generates the color image data based on light captured by the passive imaging device. The PCA 430 may provide the color image data to the audio controller 420, e.g., for further processing and communication to the mapping server 130.

The array of acoustic sensors 435 monitors and records sound in a local area surrounding some or all of the headset 110. The array of acoustic sensors 435 is an embodiment of the acoustic assembly 340 of FIG. 3B. As illustrated in FIG. 4, the array of acoustic sensors 435 include multiple acoustic sensors with multiple acoustic detection locations that are positioned on the headset 110. The array of acoustic sensors 435 may provide the recorded sound as an audio stream to the audio controller 420.

The position sensor 440 generates one or more measurement signals in response to motion of the headset 110. The position sensor 440 may be located on a portion of the frame 405 of the headset 110. The position sensor 440 may include a position sensor, an inertial measurement unit (IMU), or both. Some embodiments of the headset 110 may or may not include the position sensor 440 or may include more than one position sensors 440. In embodiments in which the position sensor 440 includes an IMU, the IMU generates IMU data based on measurement signals from the position sensor 440. Examples of position sensor 440 include: one or more accelerometers, one or more gyroscopes, one or more magnetometers, another suitable type of sensor that detects motion, a type of sensor used for error correction of the IMU, or some combination thereof. The position sensor 440 may be located external to the IMU, internal to the IMU, or some combination thereof.

Based on the one or more measurement signals, the position sensor 440 estimates a current position of the headset 110 relative to an initial position of the headset 110. The estimated position may include a location of the headset 110 and/or an orientation of the headset 110 or the user's head wearing the headset 110, or some combination thereof. The orientation may correspond to a position of each ear relative to a reference point. In some embodiments, the position sensor 440 uses the depth information and/or the absolute positional information from the DCA 425 to estimate the current position of the headset 110. The position sensor 440 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 110 from the sampled data. For example, the IMU integrates the measurement signals received from the accelerometers over time to estimate a velocity vector and integrates the velocity vector over time to determine an estimated position of a reference point on the headset 110. The reference point is a point that may be used to describe the position of the headset 110. While the reference point may generally be defined as a point in space, however, in practice the reference point is defined as a point within the headset 110.

The audio controller 420 provides audio instructions to the speakers 415*a*, 415*b* for generating sound by generating audio content using a set of acoustic parameters (e.g., a room impulse response). The audio controller 420 is an embodiment of the audio controller 350 of FIG. 3B. The audio controller 420 presents the audio content to appear originating from an object (e.g., virtual object or real object) within the local area, e.g., by transforming a source audio signal using the set of acoustic parameters for a current configuration of the local area.

The audio controller 420 may obtain visual information describing at least a portion of the local area, e.g., from the DCA 425 and/or the PCA 430. The visual information obtained at the audio controller 420 may include depth image data captured by the DCA 425. The visual information obtained at the audio controller 420 may further include color image data captured by the PCA 430. The audio controller 420 may combine the depth image data with the color image data into the visual information that is communicated (e.g., via a communication module coupled to the audio controller 420, not shown in FIG. 4) to the mapping server 130 for determination of a set of acoustic parameters. In one embodiment, the communication module (e.g., a transceiver) may be integrated into the audio controller 420. In another embodiment, the communication module may be external to the audio controller 420 and integrated into the frame 405 as a separate module coupled to the audio controller 420, e.g., the communication module 355 of FIG. 3B. In some embodiments, the audio controller 420 generates an audio stream based on sound in the local area monitored by, e.g., the array of acoustic sensors 435. The communication module coupled to the audio controller 420 may selectively communicate the audio stream to the mapping server 130 for updating the visual model of physical spaces at the mapping server 130.

Figure 5A:
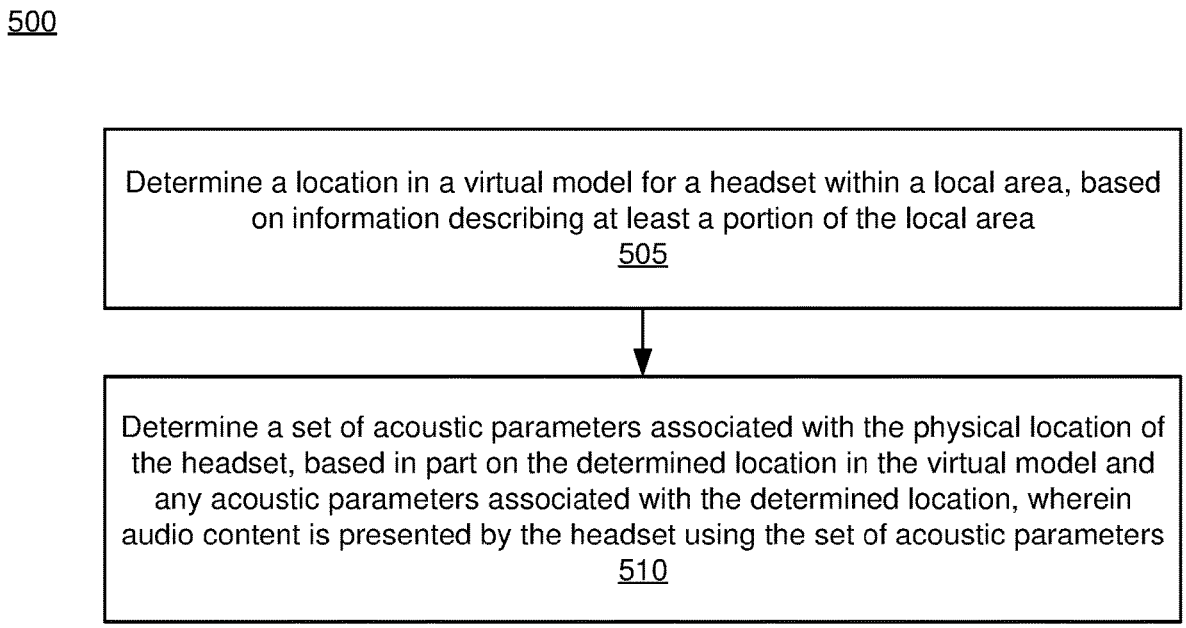
FIG. 5A is a flowchart illustrating a process for determining acoustic parameters for a physical location of a headset, in accordance with one or more embodiments.

FIG. 5A is a flowchart illustrating a process 500 for determining acoustic parameters for a physical location of a headset, in accordance with one or more embodiments. The process 500 of FIG. 5A may be performed by the components of an apparatus, e.g., the mapping server 130 of FIG. 3A. Other entities (e.g., components of the headset 110 of FIG. 4 and/or components shown in FIG. 6) may perform some or all of the steps of the process in other embodiments. Likewise, embodiments may include different and/or additional steps, or perform the steps in different orders.

The mapping server 130 determines 505 (e.g., via the mapping module 315) a location in a virtual model for a headset (e.g., the headset 110) within a local area (e.g., the room 102), based on information describing at least a portion of the local area. The virtual model stored describes a plurality of spaces and acoustic properties of those spaces, wherein the location in the virtual model corresponds to a physical location of the headset within the local area. The information describing at least the portion of the local area may include depth image data with information about a shape of at least the portion of the local area defined by surfaces of the local area (e.g., surfaces of walls, floor and ceiling) and one or more objects (real and/or virtual) in the local area. The information describing at least the portion of the local area may further include color image data for associating acoustic materials with the surfaces of the local area and with surfaces of the one or more objects. In some embodiments, the information describing at least the portion of the local area may include location information of the local area, e.g., an address of the local area, GPS location of the local area, information about latitude and longitude of the local area, etc. In some other embodiments, the information describing at least the portion of the local area includes: depth image data, color image data, information about acoustic materials for at least the portion of the local area, location information of the local area, some other information, or combination thereof.

The mapping server 130 determines 510 (e.g., via the acoustic analysis module 320) a set of acoustic parameters associated with the physical location of the headset, based in part on the determined location in the virtual model and any acoustic parameters associated with the determined location. In some embodiments, the mapping server 130 retrieves the set of acoustic parameters from the virtual model from the determined location in the virtual model associated with a space configuration where the headset 110 is currently located. In some other embodiments, the mapping server 130 determines the set of acoustic parameters by adjusting a previously determined set of acoustic parameters in the virtual model, based at least in part on the information describing at least the portion of the local area received from the headset 110. The mapping server 130 may analyze an audio stream received from the headset 110 to determine whether an existing set of acoustic parameters (if available) are consistent with the audio analysis or needs to be re-computed. If the existing acoustic parameters are not consistent with the audio analysis, the mapping server 130 may run an acoustic simulation (e.g., a wave-based acoustic simulation or ray tracing acoustic simulation) using the information describing at least the portion of the local area (e.g., room geometry, estimates of acoustic material properties) to determine a new set of acoustic parameters.

The mapping server 130 communicates the determined set of acoustic parameters to the headset for presenting audio content to a user using the set of acoustic parameters. The mapping server 130 further receives (e.g., via the communication module 310) an audio stream from the headset 110. The mapping server 130 determines (e.g., via the acoustic analysis module 320) one or more acoustic parameters based on analyzing the received audio stream. The mapping server 130 may store the one or more acoustic parameter into a storage location in the virtual model associated with a physical space where the headset 110 is located, thus creating a new entry in the virtual model in case when a current acoustic configuration of the physical space has not been yet modeled. The mapping server 130 may compare (e.g., via the acoustic analysis module 320) the one or more acoustic parameters with the previously determined set of acoustic parameters. The mapping server 130 may update the virtual model by replacing at least one acoustic parameter in the set of acoustic parameters with the one or more acoustic parameters, based on the comparison. In some embodiments, the mapping server 130 re-determines the set of acoustic parameters based on e.g., a server-based simulation algorithm, controlled measurements from the headset 110, or measurements between two or more headsets.

Figure 5B:
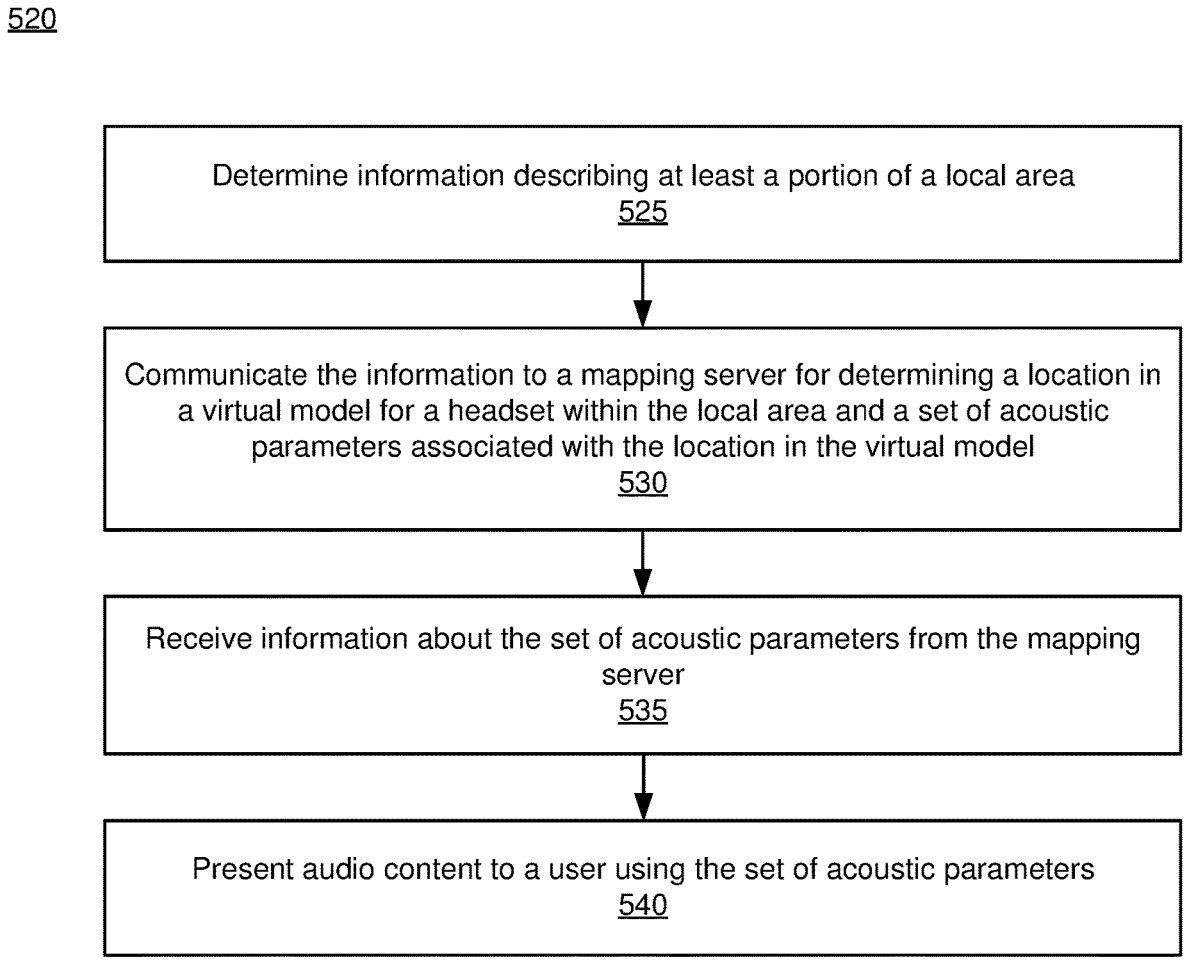
FIG. 5B is a flowchart illustrating a process for obtaining acoustic parameters from a mapping server, in accordance with one or more embodiments.

FIG. 5B is a flowchart illustrating a process 520 for obtaining a set of acoustic parameters from a mapping server, in accordance with one or more embodiments. The process 520 of FIG. 5B may be performed by the components of an apparatus, e.g., the headset 110 of FIG. 4. Other entities (e.g., components of the audio system 330 of FIG. 3B and/or components shown in FIG. 6) may perform some or all of the steps of the process in other embodiments. Likewise, embodiments may include different and/or additional steps, or perform the steps in different orders.

The headset 110 determines 525 information describing at least a portion of a local area (e.g., the room 102). The information may include depth image data (e.g., generated by the DCA 425 of the headset 110) with information about a shape of at least the portion of the local area defined by surfaces of the local area (e.g., surfaces of walls, floor and ceiling) and one or more objects (real and/or virtual) in the local area. The information may also include color image data (e.g., generated by the PCA 430 of the headset 110) for at least the portion of the local area. In some embodiments, the information describing at least the portion of the local area may include location information of the local area, e.g., an address of the local area, GPS location of the local area, information about latitude and longitude of the local area, etc. In some other embodiments, the information describing at least the portion of the local area includes: depth image data, color image data, information about acoustic materials for at least the portion of the local area, location information of the local area, some other information, or combination thereof.

The headset 110 communicates 530 (e.g., via the communication module 355) the information to the mapping server 130 for determining a location in a virtual model for the headset within the local area and a set of acoustic parameters associated with the location in the virtual model. Each location in the virtual model corresponds to a specific physical location of the headset 110 within the local area, and the virtual model describes a plurality of spaces and acoustic properties of those spaces. The headset 110 may further selectively communicate (e.g., via the communication module 355) an audio stream to the mapping server 130 for updating the set of acoustic parameters, responsive to determination at the headset 110 that a change of an acoustic condition of the local area over time is above a threshold change. The headset 110 generates the audio stream by monitoring sound in the local area.

The headset 110 receives 535 (e.g., via the communication module 355) information about the set of acoustic parameters from the mapping server 130. For example, the received information include information about a reverberation time from a sound source to the headset 110 for each of a plurality of frequency bands, a reverberant level for each frequency band, a direct to reverberant ratio for each frequency band, a direction of a direct sound from the sound source to the headset 110 for each frequency band, an amplitude of the direct sound for each frequency band, a time of early reflection of a sound from the sound source to the headset, an amplitude of early reflection for each frequency band, a direction of early reflection, room mode frequencies, room mode locations, etc.

The headset 110 presents 540 audio content to a user of the headset 110 using the set of acoustic parameters, e.g., by generating and providing appropriate acoustic instructions from the audio controller 420 to the speakers 415*a*, 415*b* (i.e., from the audio controller 350 to the transducer assembly 340). When a change occurs to a local area (room environment) causing change in an acoustic condition of the local area, the headset 110 may request and obtain from the mapping server 130 an updated set of acoustic parameters. In such case, the headset 110 presents updated audio content to the user using the updated set of acoustic parameters. Alternatively, the set of acoustic parameters can be determined locally at the headset 110, without communicating with the mapping server 130. The headset 110 may determine (e.g., via the audio controller 350) the set of acoustic parameters by running an acoustic simulation (e.g., a wave-based acoustic simulation or ray tracing acoustic simulation) using as an input information about the local area, e.g., information about geometry of the local area, estimates of acoustic material properties in the local area, etc.

Figure 5C:
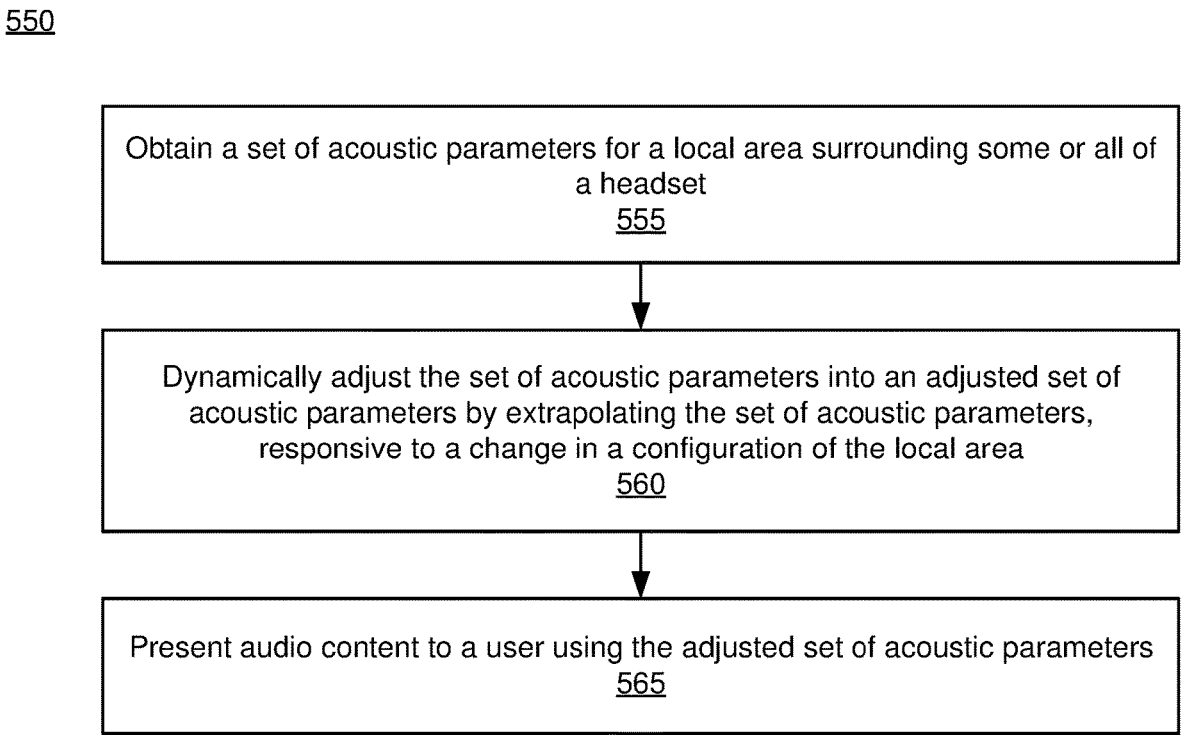
FIG. 5C is a flowchart illustrating a process for reconstructing a room impulse response at a headset, in accordance with one or more embodiments.

FIG. 5C is a flowchart illustrating a process 550 for reconstructing an impulse response for a local area, in accordance with one or more embodiments. The process 550 of FIG. 5C may be performed by the components of an apparatus, e.g., the audio system 330 of the headset 110. Other entities (e.g., components shown in FIG. 6) may perform some or all of the steps of the process in other embodiments. Likewise, embodiments may include different and/or additional steps, or perform the steps in different orders.

The headset 110 obtains 555 a set of acoustic parameters for the local area (e.g., the room 102) surrounding some or all of the headset 110. In one embodiments, the headset 130 obtains (e.g., via the communication module 355) the set of acoustic parameters from the mapping server 130. In another embodiment, the headset 110 determines (e.g., via the audio controller 350) the set of acoustic parameters, based on depth image data (e.g., from the DCA 425 of the headset 110), color image data (e.g., from the PCA 430 of the headset 110), sound in the local area (e.g., monitored by the acoustic assembly 340), information about position of the headset 110 in the local area (e.g., determined by the position sensor 440), information about position of a sound source in the local area, etc. In another embodiment, the headset 110 obtains (e.g., via the audio controller 350) the set of acoustic parameters from a computer-readable data storage (i.e., memory) coupled to the audio controller 350. The set of acoustic parameters may represent a parametrized form of a room impulse response for one configuration of the local area featuring one unique acoustic condition of the local area.

The headset 110 dynamically adjusts 560 (e.g., via the audio controller 420) the set of acoustic parameters into an adjusted set of acoustic parameters by extrapolating the set of acoustic parameters, responsive to a change in a configuration of the local area. For example, the change in configuration of the local area may be due to a change in spatial arrangement of the headset and a sound source (e.g., virtual sound source). The adjusted set of acoustic parameters may represent a parametrized form of a reconstructed room impulse response for a current (changed) configuration of the local area. For example, the direction, timing and amplitude of early reflections can be adjusted to generate the reconstructed room impulse response for the current configuration of the local area.

The headset 110 presents 565 audio content to a user of the headset 110 using the reconstructed room impulse response. The headset 110 (e.g., via the audio controller 350) may convolve an audio signal with the reconstructed room impulse response to obtain a transformed audio signal for presentation to the user. The headset 110 may generate and provide (e.g., via the audio controller 350) appropriate acoustic instructions to the transducer assembly 335 (e.g., the speakers 415*a*, 415*b*) for generating sound corresponding to the transformed audio signal.

System Environment

Figure 6:
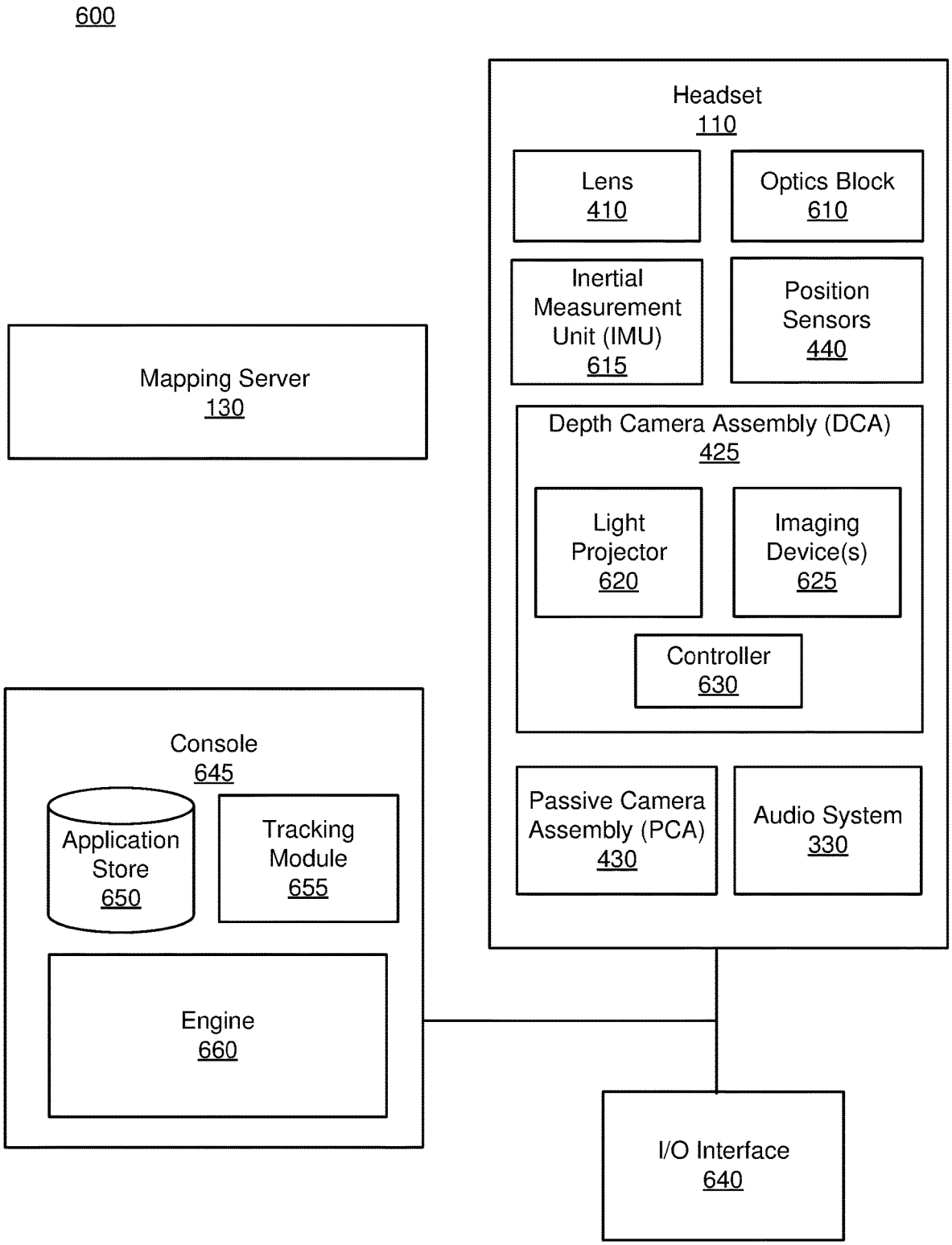
FIG. 6 is a block diagram of a system environment that includes a headset and a mapping server, in accordance with one or more embodiments.

FIG. 6 is a system environment 600 of a headset, in accordance with one or more embodiments. The system 600 may operate in an artificial reality environment, e.g., a virtual reality, an augmented reality, a mixed reality environment, or some combination thereof. The system 600 shown by FIG. 6 includes the headset 110, the mapping server 130 and an input/output (I/O) interface 640 that is coupled to a console 645. While FIG. 6 shows an example system 600 including one headset 110 and one I/O interface 640, in other embodiments any number of these components may be included in the system 600. For example, there may be multiple headsets 110 each having an associated I/O interface 640, with each headset 110 and I/O interface 640 communicating with the console 645. In alternative configurations, different and/or additional components may be included in the system 600. Additionally, functionality described in conjunction with one or more of the components shown in FIG. 6 may be distributed among the components in a different manner than described in conjunction with FIG. 6 in some embodiments. For example, some or all of the functionality of the console 645 may be provided by the headset 110.

The headset 110 includes the lens 410, an optics block 610, one or more position sensors 440, the DCA 425, an inertial measurement unit (IMU) 615, the PCA 430, and the audio system 330. Some embodiments of headset 110 have different components than those described in conjunction with FIG. 6. Additionally, the functionality provided by various components described in conjunction with FIG. 6 may be differently distributed among the components of the headset 110 in other embodiments, or be captured in separate assemblies remote from the headset 110.

The lens 410 may include an electronic display that displays 2D or 3D images to the user in accordance with data received from the console 645. In various embodiments, the lens 410 comprises a single electronic display or multiple electronic displays (e.g., a display for each eye of a user). Examples of an electronic display include: a liquid crystal display (LCD), an organic light emitting diode (OLED) display, an active-matrix organic light-emitting diode display (AMOLED), some other display, or some combination thereof.

The optics block 610 magnifies image light received from the electronic display, corrects optical errors associated with the image light, and presents the corrected image light to a user of the headset 110. In various embodiments, the optics block 610 includes one or more optical elements. Example optical elements included in the optics block 610 include: an aperture, a Fresnel lens, a convex lens, a concave lens, a filter, a reflecting surface, or any other suitable optical element that affects image light. Moreover, the optics block 610 may include combinations of different optical elements. In some embodiments, one or more of the optical elements in the optics block 610 may have one or more coatings, such as partially reflective or anti-reflective coatings.

Magnification and focusing of the image light by the optics block 610 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases all, of the user's field of view. Additionally, in some embodiments, the amount of magnification may be adjusted by adding or removing optical elements.

In some embodiments, the optics block 610 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 610 corrects the distortion when it receives image light from the electronic display generated based on the content.

The IMU 615 is an electronic device that generates data indicating a position of the headset 110 based on measurement signals received from one or more of the position sensors 440. A position sensor 440 generates one or more measurement signals in response to motion of the headset 110. Examples of position sensors 440 include: one or more accelerometers, one or more gyroscopes, one or more magnetometers, another suitable type of sensor that detects motion, a type of sensor used for error correction of the IMU 615, or some combination thereof. The position sensors 440 may be located external to the IMU 615, internal to the IMU 615, or some combination thereof.

The DCA 425 generates depth image data of a local area, such as a room. Depth image data includes pixel values defining distance from the imaging device, and thus provides a (e.g., 3D) mapping of locations captured in the depth image data. The DCA 425 includes a light projector 620, one or more imaging devices 625, and a controller 630. The light projector 620 may project a structured light pattern or other light that is reflected off objects in the local area, and captured by the imaging device 625 to generate the depth image data.

For example, the light projector 620 may project a plurality of structured light (SL) elements of different types (e.g. lines, grids, or dots) onto a portion of a local area surrounding the headset 110. In various embodiments, the light projector 620 comprises an emitter and a pattern plate. The emitter is configured to illuminate the pattern plate with light (e.g., infrared light). The illuminated pattern plate projects a SL pattern comprising a plurality of SL elements into the local area. For example, each of the SL elements projected by the illuminated pattern plate is a dot associated with a particular location on the pattern plate.

Each SL element projected by the DCA 425 comprises light in the infrared light part of the electromagnetic spectrum. In some embodiments, the illumination source is a laser configured to illuminate a pattern plate with infrared light such that it is invisible to a human. In some embodiments, the illumination source may be pulsed. In some embodiments, the illumination source may be visible and pulsed such that the light is not visible to the eye.

The SL pattern projected into the local area by the DCA 425 deforms as it encounters various surfaces and objects in the local area. The one or more imaging devices 625 are each configured to capture one or more images of the local area. Each of the one or more images captured may include a plurality of SL elements (e.g., dots) projected by the light projector 620 and reflected by the objects in the local area. Each of the one or more imaging devices 625 may be a detector array, a camera, or a video camera.

The controller 630 generates the depth image data based on light captured by the imaging device 625. The controller 630 may further provide the depth image data to the console 645, the audio controller 420, or some other component.

The PCA 430 includes one or more passive cameras that generate color (e.g., RGB) image data. Unlike the DCA 425 that uses active light emission and reflection, the PCA 430 captures light from the environment of a local area to generate image data. Rather than pixel values defining depth or distance from the imaging device, the pixel values of the image data may define the visible color of objects captured in the imaging data. In some embodiments, the PCA 430 includes a controller that generates the color image data based on light captured by the passive imaging device. In some embodiments, the DCA 425 and the PCA 430 share a common controller. For example, the common controller may map each of the one or more images captured in the visible spectrum (e.g., image data) and in the infrared spectrum (e.g., depth image data) to each other. In one or more embodiments, the common controller is configured to, additionally or alternatively, provide the one or more images of the local area to the audio controller 420 or the console 645.

The audio system 330 presents audio content to a user of the headset 110 using a set of acoustic parameters representing an acoustic property of a local area where the headset 110 is located. The audio system 330 presents the audio content to appear originating from an object (e.g., virtual object or real object) within the local area. The audio system 330 may obtain information describing at least a portion of the local area. The audio system 330 may communicate the information to the mapping server 130 for determination of the set of acoustic parameters at the mapping server 130. The audio system 330 may also receive the set of acoustic parameters from the mapping server 130.

In some embodiments, the audio system 330 selectively extrapolates the set of acoustic parameters into an adjusted set of acoustic parameters representing a reconstructed impulse response for a specific configuration of the local area, responsive to a change of an acoustic condition of the local area being above a threshold change. The audio system 330 may present audio content to the user of the headset 110 based at least in part on the reconstructed impulse response.

In some embodiments, the audio system 330 monitors sound in the local area and generates a corresponding audio stream. The audio system 330 may adjust the set of acoustic parameters, based at least in part on the audio stream. The audio system 330 may also selectively communicate the audio stream to the mapping server 130 for updating a virtual model describing a variety of physical spaces and acoustic properties of those spaces, responsive to determination that a change of an acoustic property of the local area over time is above a threshold change. The audio system 330 of the headset 110 and the mapping server 130 may communicate via a wired or wireless communication link (e.g., the network 120 of FIG. 1).

The I/O interface 640 is a device that allows a user to send action requests and receive responses from the console 645. An action request is a request to perform a particular action. For example, an action request may be an instruction to start or end capture of image or video data, or an instruction to perform a particular action within an application. The I/O interface 640 may include one or more input devices. Example input devices include: a keyboard, a mouse, a game controller, or any other suitable device for receiving action requests and communicating the action requests to the console 645. An action request received by the I/O interface 640 is communicated to the console 645, which performs an action corresponding to the action request. In some embodiments, the I/O interface 640 includes the IMU 615, as further described above, that captures calibration data indicating an estimated position of the I/O interface 640 relative to an initial position of the I/O interface 640. In some embodiments, the I/O interface 640 may provide haptic feedback to the user in accordance with instructions received from the console 645. For example, haptic feedback is provided when an action request is received, or the console 645 communicates instructions to the I/O interface 640 causing the I/O interface 640 to generate haptic feedback when the console 645 performs an action.

The console 645 provides content to the headset 110 for processing in accordance with information received from one or more of: the DCA 425, the PCA 430, the headset 110, and the I/O interface 640. In the example shown in FIG. 6, the console 645 includes an application store 650, a tracking module 655, and an engine 660. Some embodiments of the console 645 have different modules or components than those described in conjunction with FIG. 6. Similarly, the functions further described below may be distributed among components of the console 645 in a different manner than described in conjunction with FIG. 6. In some embodiments, the functionality discussed herein with respect to the console 645 may be implemented in the headset 110, or a remote system.

The application store 650 stores one or more applications for execution by the console 645. An application is a group of instructions, that when executed by a processor, generates content for presentation to the user. Content generated by an application may be in response to inputs received from the user via movement of the headset 110 or the I/O interface 640. Examples of applications include: gaming applications, conferencing applications, video playback applications, or other suitable applications.

The tracking module 655 calibrates the local area of the system 600 using one or more calibration parameters and may adjust one or more calibration parameters to reduce error in determination of the position of the headset 110 or of the I/O interface 640. For example, the tracking module 655 communicates a calibration parameter to the DCA 425 to adjust the focus of the DCA 425 to more accurately determine positions of SL elements captured by the DCA 425. Calibration performed by the tracking module 655 also accounts for information received from the IMU 615 in the headset 110 and/or an IMU 615 included in the I/O interface 640. Additionally, if tracking of the headset 110 is lost (e.g., the DCA 425 loses line of sight of at least a threshold number of the projected SL elements), the tracking module 655 may re-calibrate some or all of the system 600.

The tracking module 655 tracks movements of the headset 110 or of the I/O interface 640 using information from the DCA 425, the PCA 430, the one or more position sensors 440, the IMU 615 or some combination thereof. For example, the tracking module 655 determines a position of a reference point of the headset 110 in a mapping of a local area based on information from the headset 110. The tracking module 655 may also determine positions of an object or virtual object. Additionally, in some embodiments, the tracking module 655 may use portions of data indicating a position of the headset 110 from the IMU 615 as well as representations of the local area from the DCA 425 to predict a future location of the headset 110. The tracking module 655 provides the estimated or predicted future position of the headset 110 or the I/O interface 640 to the engine 660.

The engine 660 executes applications and receives position information, acceleration information, velocity information, predicted future positions, or some combination thereof, of the headset 110 from the tracking module 655. Based on the received information, the engine 660 determines content to provide to the headset 110 for presentation to the user. For example, if the received information indicates that the user has looked to the left, the engine 660 generates content for the headset 110 that mirrors the user's movement in a virtual local area or in a local area augmenting the local area with additional content. Additionally, the engine 660 performs an action within an application executing on the console 645 in response to an action request received from the I/O interface 640 and provides feedback to the user that the action was performed. The provided feedback may be visual or audible feedback via the headset 110 or haptic feedback via the I/O interface 640.

Additional Configuration Information

Embodiments according to the invention are in particular disclosed in the attached claims directed to a method, an apparatus, and a storage medium, wherein any feature mentioned in one claim category, e.g. method, can be claimed in another claim category, e.g. apparatus, storage medium, system, and computer program product, as well. The dependencies or references back in the attached claims are chosen for formal reasons only. However any subject matter resulting from a deliberate reference back to any previous claims (in particular multiple dependencies) can be claimed as well, so that any combination of claims and the features thereof is disclosed and can be claimed regardless of the dependencies chosen in the attached claims. The subject-matter which can be claimed comprises not only the combinations of features as set out in the attached claims but also any other combination of features in the claims, wherein each feature mentioned in the claims can be combined with any other feature or combination of other features in the claims. Furthermore, any of the embodiments and features described or depicted herein can be claimed in a separate claim and/or in any combination with any embodiment or feature described or depicted herein or with any of the features of the attached claims.

In an embodiment, a method may comprise: determining, based on information describing at least a portion of a local area, a location in a virtual model for a headset within the local area, the virtual model describing a plurality of spaces and acoustic properties of those spaces, wherein the location in the virtual model corresponds to a physical location of the headset within the local area; and determining a set of acoustic parameters associated with the physical location of the headset, based in part on the determined location in the virtual model and any acoustic parameters associated with the determined location, wherein audio content is presented by the headset using the set of acoustic parameters.

In an embodiment, a method may comprise: receiving, from the headset, the information describing at least the portion of the local area, the information including visual information about at least the portion of the local area. The plurality of spaces may include: a conference room, a bathroom, a hallway, an office, a bedroom, a dining room, and a living room. The audio content may be presented to appear originating from an object within the local area. The set of acoustic parameters may include at least one of: a reverberation time from a sound source to the headset for each of a plurality of frequency bands, a reverberant level for each frequency band, a direct to reverberant ratio for each frequency band, a direction of a direct sound from the sound source to the headset for each frequency band, an amplitude of the direct sound for each frequency band, a time of early reflection of a sound from the sound source to the headset, an amplitude of early reflection for each frequency band, a direction of early reflection, room mode frequencies, and room mode locations.

In an embodiment, a method may comprise: receiving an audio stream from the headset; determining at least one acoustic parameter based on the received audio stream; and storing the at least one acoustic parameter into a storage location in the virtual model associated with a physical space where the headset is located. The audio stream may be provided from the headset responsive to determination at the headset that a change of an acoustic condition of the local area over time is above a threshold change.

In an embodiment, a method may comprise: receiving an audio stream from the headset; and updating the set of acoustic parameters based on the received audio stream, wherein the audio content presented by the headset is adjusted based in part on the updated set of acoustic parameters.

In an embodiment, a method may comprise: obtaining one or more acoustic parameters; comparing the one or more acoustic parameters with the set of acoustic parameters; and updating the virtual model by replacing at least one acoustic parameter in the set with the one or more acoustic parameters, based on the comparison.

In an embodiment, a method may comprise: transmitting the set of acoustic parameters to the headset for extrapolation into an adjusted set of acoustic parameters responsive to a change of an acoustic condition of the local area being above a threshold change.

In an embodiment, an apparatus may comprise: a mapping module configured to determine, based on information describing at least a portion of a local area, a location in a virtual model for a headset within the local area, the virtual model describing a plurality of spaces and acoustic properties of those spaces, wherein the location in the virtual model corresponds to a physical location of the headset within the local area; and an acoustic module configured to determine a set of acoustic parameters associated with the physical location of the headset, based in part on the determined location in the virtual model and any acoustic parameters associated with the determined location, wherein audio content is presented by the headset using the set of acoustic parameters.

In an embodiment, an apparatus may comprise: a communication module configured to receive, from the headset, the information describing at least the portion of the local area, the information including visual information about at least the portion of the local area captured via one or more camera assemblies of the headset. The audio content may be presented to appear originating from a virtual object within the local area. The set of acoustic parameters may include at least one of: a reverberation time from a sound source to the headset for each of a plurality of frequency bands, a reverberant level for each frequency band, a direct to reverberant ratio for each frequency band, a direction of a direct sound from the sound source to the headset for each frequency band, an amplitude of the direct sound for each frequency band, a time of early reflection of a sound from the sound source to the headset, an amplitude of early reflection for each frequency band, a direction of early reflection, room mode frequencies, and room mode locations.

In an embodiment, an apparatus may comprise: a communication module configured to receive an audio stream from the headset, wherein the acoustic module is further configured to determine at least one acoustic parameter based on the received audio stream, and the apparatus further comprising a non-transitory computer-readable medium configured to store the at least one acoustic parameter into a storage location in the virtual model associated with a physical space where the headset is located. The acoustic module may be configured to: obtain one or more acoustic parameters; and compare the one or more acoustic parameters with the set of acoustic parameters, and the apparatus further comprising a non-transitory computer-readable storage medium configured to update the virtual model by replacing at least one acoustic parameter in the set with the one or more acoustic parameters, based on the comparison. In an embodiment, an apparatus may comprise: a communication module configured to transmit the set of acoustic parameters to the headset for extrapolation into an adjusted set of acoustic parameters responsive to a change of an acoustic condition of the local area being above a threshold change.

In an embodiment, a non-transitory computer-readable storage medium may have instructions encoded thereon that, when executed by a processor, cause the processor to perform a method according to any of the embodiments herein or to: determine, based on information describing at least a portion of a local area, a location in a virtual model for a headset within the local area, the virtual model describing a plurality of spaces and acoustic properties of those spaces, wherein the location in the virtual model corresponds to a physical location of the headset within the local area; and determine a set of acoustic parameters associated with the physical location of the headset, based in part on the determined location in the virtual model and any acoustic parameters associated with the determined location, wherein audio content is presented by the headset using the set of acoustic parameters.

The instructions may cause the processor to: receive an audio stream from the headset; determine at least one acoustic parameter based on the received audio stream; and store the at least one acoustic parameter into a storage location in the virtual model associated with a physical space where the headset is located, the virtual model stored in the non-transitory computer-readable storage medium. The instructions may cause the processor to: obtain one or more acoustic parameters; compare the one or more acoustic parameters with the set of acoustic parameters; and update the virtual model by replacing at least one acoustic parameter in the set with the one or more acoustic parameters, based on the comparison.

In an embodiment, one or more computer-readable non-transitory storage media may embody software that is operable when executed to perform a method according to or within any of the above mentioned embodiments.

In an embodiment, a system may comprise: one or more processors; and at least one memory coupled to the processors and comprising instructions executable by the processors, the processors operable when executing the instructions to perform a method according to or within any of the above mentioned embodiments.

In an embodiment, a computer program product, preferably comprising a computer-readable non-transitory storage media, may be operable when executed on a data processing system to perform a method according to or within any of the above mentioned embodiments.

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A method comprising:

determining information describing at least a portion of a local area;

communicating the information to a mapping server for determining a location of a plurality of locations in a virtual model for a headset within the local area and a set of acoustic parameters associated with the location, the virtual model describing a plurality of physical spaces and acoustic properties of the physical spaces, each of the physical spaces being represented in the virtual model with a plurality of space configurations, each space configuration associated with a respective unique set of acoustic parameters stored in a respective location of the plurality of locations;

receiving information about the set of acoustic parameters from the mapping server; and presenting audio content using the set of acoustic parameters.

2. The method of claim 1, further comprising:

determining visual information about at least the portion of the local area; and communicating the visual information to the mapping server for determining the location in the virtual model for the headset.

3. The method of claim 1, wherein the plurality of physical spaces includes: a conference room, a bathroom, a hallway, an office, a bedroom, a dining room, and a living room.

4. The method of claim 1, further comprising:

presenting the audio content to appear originating from an object within the local area.

5. The method of claim 1, wherein the set of acoustic parameters includes at least one of:

a reverberation time from a sound source to the headset for each of a plurality of frequency bands, a reverberant level for each frequency band, a direct to reverberant ratio for each frequency band, a direction of a direct sound from the sound source to the headset for each frequency band, an amplitude of the direct sound for each frequency band, a time of early reflection of a sound from the sound source to the headset, an amplitude of early reflection for each frequency band, a direction of early reflection, room mode frequencies, and room mode locations.

6. The method of claim 1, further comprising:

communicating an audio stream to the mapping server for determining at least one acoustic parameter of the respective unique set of acoustic parameters based on the audio stream, the at least one acoustic parameter being stored into the respective location of the plurality of locations in the virtual model associated with a space configuration of a physical space of the plurality of physical spaces where the headset is located.

7. The method of claim 6, further comprising:

tracking an acoustic condition of the local area over time;

determining a change of the acoustic condition of the local area over time; and communicating the audio stream to the mapping server in response to determining the change.

8. The method of claim 1, further comprising:

communicating an audio stream to the mapping server for updating the set of acoustic parameters based on the audio stream;

receiving the updated set of acoustic parameters from the mapping server; and presenting the audio content adjusted based in part on the updated set of acoustic parameters.

9. The method of claim 1, further comprising:

determining acoustic information by running an acoustic ray tracing simulation; and communicating the determined acoustic information to the mapping server for comparing with the set of acoustic parameters, the virtual model being updated by replacing at least one acoustic parameter in the set with the determined acoustic information based on the comparison.

10. The method of claim 1, further comprising:

receiving the set of acoustic parameters from the mapping server;

determining a change of an acoustic condition of the local area;

responsive to determining the change, extrapolating the set of acoustic parameters into an adjusted set of acoustic parameters; and presenting the audio content adjusted based in part on the adjusted set of acoustic parameters.

11. The method of claim 1, further comprising:

receiving the set of acoustic parameters from the mapping server;

reconstructing a room impulse response for a space configuration of the local area by extrapolating the set of acoustic parameters; and presenting the audio content adjusted based in part on the reconstructed room impulse response.

12. An audio system comprising:

a communication module configured to:

communicate, to a mapping server, information describing at least a portion of a local area for determining a location of a plurality of locations in a virtual model for the audio system within the local area and a set of acoustic parameters associated with the location, the virtual model describing a plurality of physical spaces and acoustic properties of the physical spaces, each of the physical spaces being represented in the virtual model with a plurality of space configurations, each space configuration associated with a respective unique set of acoustic parameters stored in a respective location of the plurality of locations, and receive information about the set of acoustic parameters from the mapping server; and an audio controller configured to present audio content using the set of acoustic parameters.

13. The audio system of claim 12, wherein the audio system is interfaced with a camera assembly configured to determine visual information about at least the portion of the local area, and the communication module is further configured to:

communicate the visual information to the mapping server for determining the location in the virtual model for the audio system.

14. The audio system of claim 12, wherein the audio controller is further configured to:

present the audio content to appear originating from an object within the local area.

15. The audio system of claim 12, wherein the set of acoustic parameters includes at least one of:

a reverberation time from a sound source to the audio system for each of a plurality of frequency bands, a reverberant level for each frequency band, a direct to reverberant ratio for each frequency band, a direction of a direct sound from the sound source to the audio system for each frequency band, an amplitude of the direct sound for each frequency band, a time of early reflection of a sound from the sound source to the audio system, an amplitude of early reflection for each frequency band, a direction of early reflection, room mode frequencies, and room mode locations.

16. The audio system of claim 12, further comprising:

an acoustic assembly configured to monitor an acoustic condition of the local area over time, wherein the audio controller is further configured to determine a change of the acoustic condition of the local area over time; and the communication module is further configured to, in response to determining the change, communicate an audio stream to the mapping server for determining at least one acoustic parameter of the respective unique set of acoustic parameters based on the audio stream, the at least one acoustic parameter being stored into the respective location of the plurality of locations in the virtual model associated with a space configuration of a physical space of the plurality of physical spaces where the headset is located.

17. The audio system of claim 12, wherein:

the communication module is further configured to communicate an audio stream to the mapping server for updating the set of acoustic parameters based on the audio stream, and receive the updated set of acoustic parameters from the mapping server; and the audio controller is further configured to present the audio content adjusted based in part on the updated set of acoustic parameters.

18. The audio system of claim 12, wherein:

the audio controller is further configured to determine acoustic information by running an acoustic ray tracing simulation; and the communication module is further configured to communicate the determined acoustic information to the mapping server for comparing with the set of acoustic parameters, the virtual model being updated by replacing at least one acoustic parameter in the set with the determined acoustic information based on the comparison.

19. The audio system of claim 12, wherein:

the communication module is further configured to receive the set of acoustic parameters from the mapping server; and the audio controller is further configured to:

determine a change of an acoustic condition of the local area monitored by an acoustic assembly of the audio system, responsive to determining the change, extrapolate the set of acoustic parameters into an adjusted set of acoustic parameters, and present the audio content adjusted based in part on the adjusted set of acoustic parameters.

20. A non-transitory computer-readable storage medium having instructions encoded thereon that, when executed by a processor, cause the processor to:

determine information describing at least a portion of a local area;

communicate the information to a mapping server for determining a location of a plurality of locations in a virtual model for a headset within the local area and a set of acoustic parameters associated with the location, the virtual model describing a plurality of physical spaces and acoustic properties of the physical spaces, each of the physical spaces being represented in the virtual model with a plurality of space configurations, each space configuration associated with a respective unique set of acoustic parameters stored in a respective location of the plurality of locations;

receive information about the set of acoustic parameters from the mapping server; and present audio content using the set of acoustic parameters.

* * * * *